US006805094B2

(12) United States Patent
Hashimoto et al.

(10) Patent No.: US 6,805,094 B2
(45) Date of Patent: Oct. 19, 2004

(54) ON-VEHICLE ENGINE CONTROL APPARATUS

(75) Inventors: Kohji Hashimoto, Tokyo (JP); Katsuya Nakamoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 29 days.

(21) Appl. No.: 10/292,603

(22) Filed: Nov. 13, 2002

(65) Prior Publication Data

US 2003/0221668 A1 Dec. 4, 2003

(30) Foreign Application Priority Data

May 30, 2002 (JP) ..... P2002-158004

(51) Int. Cl.[7] ..... F02D 1/00
(52) U.S. Cl. ..... 123/396; 123/399; 701/110
(58) Field of Search ..... 123/361, 399, 123/396; 701/110, 114; 73/118.2

(56) References Cited

U.S. PATENT DOCUMENTS

| | | | | |
|---|---|---|---|---|
| 5,823,164 | A | * 10/1998 | Seki et al. | 123/396 |
| 5,875,760 | A | * 3/1999 | Bauer et al. | 123/397 |
| 6,109,239 | A | * 8/2000 | Watanabe | 123/396 |
| 6,178,947 | B1 | * 1/2001 | Machida et al. | 123/396 |
| 6,273,061 | B1 | * 8/2001 | Hosoi | 123/333 |
| 6,276,331 | B1 | * 8/2001 | Machida et al. | 123/396 |
| 6,276,332 | B1 | * 8/2001 | Storhok et al. | 123/397 |
| 6,450,145 | B2 | * 9/2002 | Machida et al. | 123/396 |
| 6,647,959 | B2 | * 11/2003 | Noguchi | 123/396 |
| 6,718,254 | B2 | * 4/2004 | Hashimoto et al. | 701/110 |

FOREIGN PATENT DOCUMENTS

| | | |
|---|---|---|
| JP | 2176141 | 7/1990 |
| JP | 50812222 | 4/1993 |
| JP | 6249015 | 9/1994 |
| JP | 62778502 | 10/1994 |
| JP | 8339308 | 12/1996 |
| JP | 5601063 | 2/1997 |
| JP | 11002152 | 1/1999 |
| JP | 11141389 | 5/1999 |
| JP | 2000097087 | 4/2000 |

OTHER PUBLICATIONS

U.S. patent application Ser. No. 09/813,947, Nakamoto, filed Mar. 22, 2001.
U.S. patent application Ser. No. 10/127,725, Hashimoto et al., filed Apr. 23, 2002.
U.S. patent application Ser. No. 10/040783, Hashimoto et al., filed Jan. 9, 2002.

* cited by examiner

*Primary Examiner*—Hai Huynh
(74) *Attorney, Agent, or Firm*—Sughrue Mion, PLLC

(57) ABSTRACT

An on-vehicle engine control apparatus carries out engine drive control and throttle control using one single CPU and improves safety. The apparatus includes a load relay for feeding a power to a motor that controls throttle valve opening, a first IC (integrated circuit element) containing a CPU, and a second IC connected to the first IC via serial interfaces. The apparatus further includes a first mutual diagnostic device incorporated in the first IC and diagnoses operation of the second IC, a second mutual diagnostic device incorporated in the second IC to diagnoses operation of the first IC, and a detector for detecting an abnormality in operation of each system involved in throttle valve control. Operation of the load relay is controlled based on diagnostic results and abnormality detection results of the first and second mutual diagnostic devices.

12 Claims, 14 Drawing Sheets

ON-VEHICLE ENGINE CONTROL APPARATUS

BACKGROUND OF THE INVENTION

1. Field of the Invention

The present invention relates to an on-vehicle engine control apparatus in which an intake amount of vehicle engine and so on are electronically controlled by an electric motor.

In particular, the invention relates to an on-vehicle engine control apparatus for carrying out electronic control of an intake amount and so on employing a system in which a CPU (microprocessor) is used to carry out main control of ignition/fuel supply of engine and so on as a whole, and by which safety in controlling the whole engine is improved.

2. Description of the Related Art

Electronic throttle control has been widely put into practical use so that intake throttle valve opening of an engine is controlled by an electric motor according to degree of working an accelerator pedal. It is a recent trend to employ a wireless type control without accelerator wire. But there is another type of control that uses an accelerator acting as backup means in combination with a motor, or a further type in which an accelerator wire is used in normal driving and an electric motor is used in constant-speed driving.

On the other hand, the entire engine control includes main control for an engine drive unit such as ignition coil (in case of gasoline engine) or fuel injection valve and auxiliary control for peripheral machine such as a transmission solenoid valve or an air conditioner driving electromagnetic clutch. Various types of CPU have been heretofore proposed in the aspect of combining the engine control with the mentioned throttle control.

FIG. 10 shows a constitution of a CPU for use in an on-vehicle engine control apparatus according to a first type of prior art and, in this type, one single CPU 1*a* carries out the entire control.

Connected to this CPU 1*a* are a sensor for detecting an engine speed, a crank angle sensor, an airflow sensor for measuring an intake amount, an intake pressure sensor, an exhaust gas sensor, a coolant temperature sensor, an accelerator position sensor (hereinafter referred to as APS) for measuring a degree of working the accelerator pedal, a throttle position sensor (hereinafter referred to as TPS) for measuring a throttle valve opening, a shift position sensor for detecting a transmission lever position, and a large number of on-off or analog input signals 11*a*.

Control outputs of the CPU 1*a* includes main machinery/auxiliary machinery control outputs 21*a* such as an ignition coil, a fuel injection solenoid valve, a transmission solenoid valve, an exhaust gas circulation control solenoid valve, etc., and a throttle control motor 22*a*.

The Japanese Patent Publication (unexamined) No. 176141/1990 titled "Control Apparatus for Internal Combustion Engine" and the Japanese Patent Publication (unexamined) No. 141389/1999 titled "Throttle Control Apparatus of Internal Combustion Engine" disclose this first type of prior art as described above in which the entire control is carried out by one single CPU.

A problem exists in such a type of carrying out the entire control using one CPU. For example, such a type of control system is insufficient in safety at the time of occurrence of any error or abnormality in the system, and performance and specification are not sufficiently secured because of a heavy burden on the CPU.

Particularly since it is possible to prevent the engine from running out of control by accurately suppressing an intake amount, control of the intake amount is the most important requirement in terms of safety. Therefore it is a market trend to employ required sensors and CPU in the form of dual system for the electronic throttle control.

FIG. 11 shows a constitution of a CPU for use in an on-vehicle engine control apparatus according to a second type of prior art. In this second type, main machinery and auxiliary machinery 21*b* are controlled by a first CPU (CPU 1) 1*b*, and main machinery/auxiliary machinery control input signals 11*b* is connected to the required CPU.

A second CPU (CPU 2) 2*b* receives a throttle control input signal 12*b* of the APS, the TPS, etc. and controls a throttle control motor 22*b*. A third CPU (CPU 3) 3*b* receives a monitor control input signal 13*b* and generates a monitor control output 23*b*, thereby safety of the electronic throttle control is improved.

The Japanese Patent Publication (unexamined) No. 278502/1994 titled "Cruise Control Apparatus" and the Japanese Patent Publication (unexamined) No. 2152/1999 titled "Constant-Speed Driving Apparatus for Vehicle" do not mention the foregoing first CPU (CPU 1) 1*b*. But those patent literatures gives a description defined to a throttle control in which the second CPU (CPU 2) 2*b* acts as a main CPU and the third CPU (CPU 3) 3*b* acts as a sub-CPU.

In this concept, a constant-speed control apparatus is added to the conventional accelerator-wire-type engine control apparatus, and consequently, the constitution with the three CPUs is complicated and expensive.

FIG. 12 shows a constitution of a CPU for use on-vehicle engine control apparatus according to a third type of prior art. In this third type, main machinery and auxiliary machinery 21*c* are controlled by a first CPU (CPU 1) 1*c*. A related main machinery/auxiliary machinery control input signal 11*c* is connected to the CPU 1*c*.

A second CPU (CPU 1) 2*c* receives a throttle control input signal and a monitor control input signal 12*c* of the APS, the TPS, and so on, and generates a control output and a monitor control output 22*c* to the throttle control motor. The first CPU (CPU 1) 1*c* and the second CPU (CPU 2) 2*c* monitor each other.

In the CPU constitution of this type, the first CPU (CPU 1) 1*c* acts as a so-called ECU (engine control unit) and the second CPU (CPU 2) 2*c* acts as a so-called a TCU (a throttle control unit). In this manner, this constitution intends to improve safety of the entire system through mutual monitoring.

"Engine Control Apparatus" disclosed in the Japanese Patent Publication (unexamined) No. 270488/1996 is of a two-CPU constitution in which an accelerator wire is jointly used, and "Throttle Valve Control Apparatus" disclosed in the Japanese Patent Publication (unexamined) No. 97087/2000 is of a wireless two-CPU constitution.

Both of them disclose fail-safe control means that enables smooth limp/home driving in case of occurrence of any abnormality.

On the other hand, in the Japanese Patent Publication (unexamined) No. 249015/1994 titled "Control Apparatus for Vehicle", the control apparatus is provided with a bypass valve for limp driving. A motor controls opening of the main throttle valve to be fully closed and returned by a return spring. This prior art discloses limp driving means acting in case of an excess-open abnormality when it is impossible to fully close and return the main throttle valve due to an abnormality in the motor, an actuator, or the like.

In the prior arts described above, an idle cylinder level is set conforming to an output voltage of the throttle position sensor (TPS) that detects a main throttle valve opening and to an output voltage of the accelerator position sensor (APS) that detects a degree of acting the accelerator pedal. Fuel supply to a part of a multi-cylinder engine is stopped, and number of effective cylinders is reduced in order to suppress the engine speed.

In the prior arts as described above, there still remain several problems in using only one single CPU. For example, safety is not assured and a burden on the CPU control is excessively heavy, and it is therefore essential to reduce the burden on the CPU and improve safety monitoring.

However, the engine drive control such as ignition control or fuel injection control is closely related to the throttle control, and it will not be a good idea to carry out separately the engine drive control and the throttle control with separate CPUs.

SUMMARY OF THE INVENTION

Accordingly, a first object of the present invention is to provide an on-vehicle engine control apparatus suitable for carrying out an engine drive control and a throttle control together in a batch using one single microprocessor thereby improving safety of the apparatus.

A second object of the invention is to provide fail-safe control means for facilitating limp driving in case of occurrence of any abnormality.

An on-vehicle engine control apparatus according to the invention includes: a motor for carrying out an intake throttle valve opening control conforming to an output of one of a pair of accelerator position sensors that detects a degree of working an accelerator pedal and an output of one of a pair of throttle position sensors that detects the mentioned throttle valve opening; and an engine drive that includes at least one fuel injection solenoid valve.

The on-vehicle engine control apparatus also includes: a load relay that feeds the mentioned motor with a power supply and returns the mentioned throttle valve opening to a predetermined position by interrupting the mentioned power supply; a first integrated circuit element that includes a microprocessor and generates a first control output for controlling a throttle valve to the mentioned motor and a second control output to the mentioned engine drive; and a second integrated circuit element that is connected to the mentioned first integrated circuit element via a serial interface and generates a driving output to the mentioned load relay in cooperation with the mentioned microprocessor of the mentioned first integrated circuit element.

Furthermore, the mentioned on-vehicle engine control apparatus includes: first mutual diagnostic means that is incorporated in the mentioned first integrated circuit element and diagnoses whether or not there is any abnormality in operation of the mentioned second integrated circuit element; second mutual diagnostic means that is incorporated in the mentioned second integrated circuit element and diagnoses whether or not there is any abnormality in operation of the mentioned first integrated circuit element; and abnormality detection means that monitors operation of a sensor system, a control system, and an actuator system related to the mentioned throttle valve control at all times and generates an abnormality detection output at the time of occurring any abnormality.

In the mentioned on-vehicle engine control apparatus, operation of the mentioned load relay is preferably controlled conforming to a diagnostic result of the operation of the mentioned second integrated circuit element carried out by the mentioned first mutual diagnostic means, a diagnostic result of the operation of the mentioned first integrated circuit element carried out by the mentioned second mutual diagnostic means, and the output of the mentioned abnormality detection means.

As a result, in the on-vehicle engine control apparatus of the invention, one single microprocessor can integrally control the first control output and the second control output closely related to the engine speed control. This facilitates transmitting and receiving mutually related control signals thereby response and performance in control being improved.

Furthermore, in the on-vehicle engine control apparatus of the invention, the load relay is operated on the basis of a diagnostic result of the first mutual diagnostic means and the second mutual diagnostic means cooperating each other in detecting an abnormality and an abnormality detection output of the abnormality detection means that monitors an abnormality in the operation of the sensor system, the control system, and the actuator system related to the throttle valve control. As a result, safety performance is improved and one single CPU can carry out integrally the engine drive control and the throttle control.

Another on-vehicle engine control apparatus according to the invention includes: a motor for carrying out an intake throttle valve opening control conforming to an output of one of a pair of accelerator position sensors that detects a degree of working an accelerator pedal and an output of one of a pair of throttle position sensors that detects the mentioned throttle valve opening; a load relay that controls an electric power supply to the mentioned motor; and a default position return mechanism that returns the mentioned throttle valve opening to a limp driving default position when the mentioned load relay interrupts the electric power supply. The control apparatus is supplied with a power from an on-vehicle battery via a power supply switch and generates at least a first control output that carries out drive control of the mentioned motor, a second control output that controls a solenoid valve for injecting a fuel to an engine, and a third output that drives the mentioned load relay. The on-vehicle engine control apparatus further includes: minimum threshold value setting means for setting a minimum threshold value that operates when a normal throttle position sensor output is not received and sets a predetermined engine speed slightly higher than an idle engine speed that is a minimum engine speed necessary for maintaining stable rotation of the engine; and normal threshold value means for setting a normal threshold value that operates when a normal throttle position sensor output is received and calculates and sets an engine speed which is approximately in inverse proportion to the throttle valve opening detected by the throttle position sensor.

The mentioned on-vehicle engine control apparatus further includes engine speed suppressing means for suppressing an engine speed. This engine speed suppressing means operates when the mentioned load relay is interrupted, and suppresses an engine speed by adjusting a fuel supply amount on the basis of the mentioned second control output, in response to a deviation between a predetermined engine speed set by the mentioned minimum threshold value setting means or by the normal threshold value setting means and an actual engine speed.

As a result, in the on-vehicle engine control apparatus of the invention, safety is improved by returning the throttle valve opening to the predetermined position using a fail-safe mechanism independent of electronic control. Even when the throttle valve opening is not returned to the normal position due to any abnormality in the fail-safe mechanism and none of the throttle position sensors are operating normally, it is possible to carry out limp driving at the minimum threshold engine speed.

In the on-vehicle engine control apparatus of the invention, even when the throttle valve opening is not returned to the normal position due to any abnormality in the fail-safe mechanism, it is possible to carry out limp driving at the normal threshold engine speed as long as the throttle position sensors are effective.

Furthermore, the foregoing normal threshold engine speed makes it possible to obtain an approximately constant engine output torque irrespective of a degree of the throttle valve opening that is stopped due to any abnormality.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1.

Figure 1:
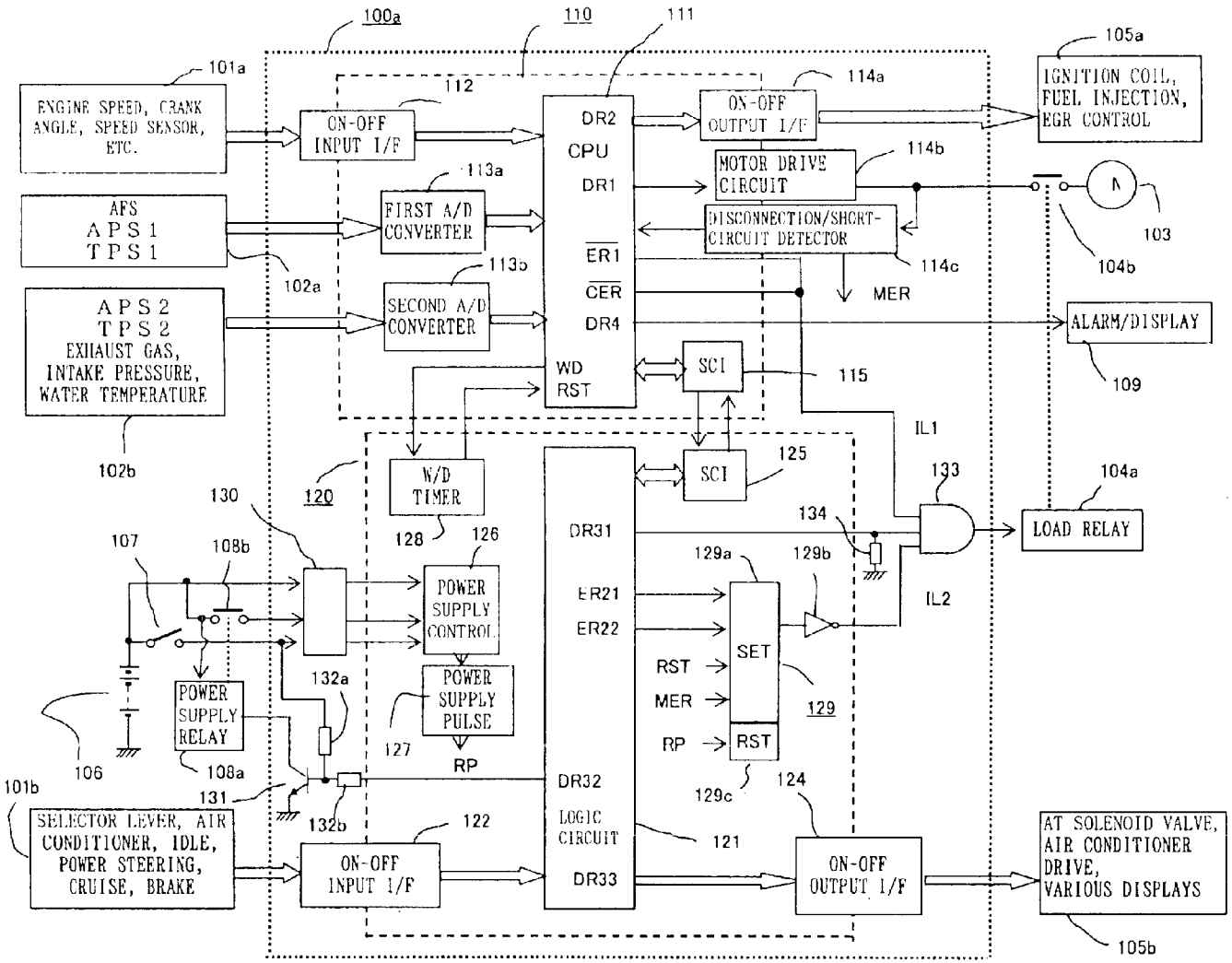
FIG. 1 is a block diagram for explaining a constitution of an on-vehicle engine control apparatus according to Embodiment 1 of the present invention.

FIG. 1 is a block diagram for explaining a constitution of an on-vehicle engine control apparatus according to Embodiment 1 of the invention.

In FIG. 1, numeral 100*a* is an electronic control apparatus comprised of an electronic circuit board accommodated in a closed box member not shown in the drawing. This electronic control apparatus 100*a* is mainly composed of a first integrated circuit element 110, a second integrated circuit element 120, and an electronic circuit packaged on the electronic circuit board outside the integrated circuit elements described later.

The electronic control apparatus 100*a* is connected to external input/output equipment via a connector not shown. Now the external input/output equipment is hereinafter described.

Numeral 101*a* is a first group of on-off input sensors including an engine speed sensor, a crank angle sensor, and a vehicle speed sensor. Input signals of those sensors are of high-speed and high frequency operation, in which it is required to read frequent on-off operation in a microprocessor at a high speed.

Numeral 101*b* is a second group of on-off input sensors including a transmission shift lever selective position sensor, an air conditioner switch, a switch for detecting an idle position of an accelerator pedal, a power steering operation switch, a cruise switch for constant-speed driving, and a brake switch. Input signals of those sensors are of low-speed operation and low frequency, in which delay in responding to the reading of on-off operation does not cause a serious problem.

Numeral 102*a* is a first group of analog input sensors including an airflow sensor (AFS) measuring a throttle intake amount, a first accelerator position sensor (APS 1) for measuring the degree of working the accelerator pedal, and a first throttle position sensor (TPS 1) for measuring the throttle valve opening. Numeral 102*b* is a second group of analog input sensors including a second accelerator position sensor (APS 2), a second throttle position sensor (TPS 2), an exhaust gas sensor, a coolant temperature sensor, and an intake pressure sensor. The mentioned APS 1 and APS 2 and the mentioned TPS 1 and TPS 2 are disposed double from the viewpoint of safety.

Numeral 103 is a motor for controlling opening and closing of the intake throttle valve, and numeral 104*a* is a load relay for feeding and interrupting a power supply to the foregoing motor 103 via an output contact 104*b*. When acting the load relay 104*a*, a power supply circuit of the motor 103 is closed.

Numeral 105*a* is an engine drive including an engine ignition coil (in case of a gasoline engine), a fuel injection solenoid valve, and a solenoid valve for circulating and combusting exhaust gas (or a stepping motor). Numeral 105*b* is a peripheral auxiliary machinery including a solenoid valve for changing transmission gear, an electromagnetic clutch for driving an air conditioner, and various display devices. Numeral 106 is an on-vehicle battery, and numeral 107 is a power switch such as an ignition switch. Numeral 108*a* is a power supply relay provided with an output contact 108*b* and fed with a power from the on-vehicle battery 106, and numeral 109 is alarm/display devices for throttle control. The mentioned ignition coil is not disposed in case of a diesel engine.

In the foregoing first integrated circuit element 110, numeral 111 is a microprocessor of thirty-two bits, for example, and numeral 112 is an input interface connected between the foregoing first on-off input sensor group 101*a* and the microprocessor 111. Numeral 113*a* is a first A/D converter (analog-to-digital converter) connected between the first analog input sensor group 102*a* and the microprocessor 111, and numeral 113*b* is a second A/D converter (analog-to-digital converter) connected between the second analog input sensor group 102*b* and the microprocessor 111. The mentioned input interface 112 is composed of heat-generating components of DC 12 V system directly mounted on an electronic circuit board not shown in the drawing, and low-power consumption circuit components of DC 5 V system accommodated in the mentioned first integrated circuit element 110.

Numeral 114*a* is an output interface for carrying out on-off drive of the engine drive 105*a* on the basis of a second control output DR2 generated by the foregoing microprocessor 111. This foregoing output interface 114*a* is composed of low-power consumption circuit components of DC 5 V system accommodated in the first integrated circuit element 110, and a power transistor of DC 12 V system directly mounted on the electronic circuit board not shown in the drawing, and so on.

Numeral 114*b* is a motor drive circuit composed of an interface power transistor circuit for carrying out on-off drive of the motor 103 on the basis of a first control output DR1 generated by the microprocessor 111, and numeral 114*c* is a disconnection/short-circuit detection circuit of the motor 103.

The disconnection/short-circuit detection circuit 114*c* generates a circuit abnormality detection output MER in a case where a motor current of not lower than a predetermined value flows (short circuit) at the time of driving the motor or in a case where a leakage current for detecting disconnection does not flow (disconnection) at the time of driving the motor. Thus, disconnection and short circuit of a wiring circuit are also detected.

The motor drive circuit 114*b* and the disconnection/short-circuit detection circuit 114*c* are separately disposed on the first integrated circuit element 110 and the electronic circuit board not shown in the same manner as the output interface 114*a* and the input interface 112.

Numerals 115 and 125 are serial interfaces (SCI) composed of serial-parallel converters for transmitting and receiving a serial signal between the first integrated circuit element 110 and the second integrated circuit element 120 in cooperation with each other.

A communication diagnostic output ER1, which is described later with reference to FIGS. 5 and 6, acts as a first mutual diagnostic output in which a state of serial communication of the second integrated circuit element 120 is monitored by the first integrated circuit element 110.

A control abnormality detection output CER, which is described later with reference to FIG. 4, acts as an abnormality detection output for the accelerator position sensors, the throttle position sensors, or the entire actuator for throttle control.

An alarm/display output DR4 is an output transmitted to the alarm/display devices, and a watchdog timer clear signal WD is a signal transmitted to a watchdog timer (W/D timer) 128 described later. RST is a reset output generated by the watchdog timer 128 described later in order to initialize the mentioned microprocessor 111.

In the mentioned second integrated circuit element 120, numeral 121 is a logic circuit section, numeral 122 is an input interface connected between the second on-off input sensor group 101*b* and the logic circuit section 121, and numeral 124 is an output interface composed of an interface power transistor circuit for carrying out on-off drive of the peripheral auxiliary machinery 105*b* on the basis of a third control output DR33 via the logic circuit section 121.

In addition, the on-off signals of the mentioned second on-off input sensor group 101*b* are transmitted to the microprocessor 111 via the serial interfaces 125 and 115 after carrying out noise-filtering in the logic circuit section 121. Meanwhile the microprocessor 111 generates the third control output DR33 and transmits the output DR33 to the logic circuit section 121 via the serial interfaces 115 and 125.

The input interface 122 is composed of heat-generating components of DC 12 V system directly mounted on the electronic circuit board not shown in the drawing, and a low-power consumption circuit components of DC 5 V system accommodated in the second integrated circuit element 120.

The output interface 124 is composed of low-power consumption circuit components of DC 5 V system accommodated in the second integrated circuit element 120, a power transistor of a DC 12 V system directly mounted on the electronic circuit board not shown, and so on.

Numeral 126 is a stabilizing power supply control circuit for feeding a power to the foregoing first integrated circuit element 110 and second integrated circuit element 120. Numeral 127 is a power supply detection circuit for generating a power supply detection pulse output RP for a short time at the time of turning on or off the power supply. Numeral 128 is a watchdog timer for monitoring a watchdog timer clear signal WD generated by the microprocessor 111 and generating the reset output RST when any pulse train of a predetermined period width is not generated, thereby restarting the microprocessor 111. Numeral 129 is an abnormality storage element composed of a set input section 129*a* and a reset input section 129*c*. Numeral 129*b* is an OR circuit connected to a set output section of the abnormality storage element 129.

Numeral ER21 is a communication diagnostic output (one of second mutual diagnostic outputs) described later with reference to FIGS. 3 and 5, and numeral ER22 is a circulation diagnostic output (one of the second mutual diagnostic outputs) described later with reference to FIG. 3. The abnormality storage element 129 is set by any of the circuit abnormality detection output MER, the reset output RST, the communication diagnostic output ER21 and the circulation diagnostic output ER22, and is reset by the power supply detection pulse output RP.

Numerals 130, 131, 132*a*, and 132*b* are various components disposed outside the mentioned first integrated circuit element 110 and the second integrated circuit element 120. Numeral 130 is an open/close element connected to a sleeping power supply directly fed with a power from the on-vehicle battery 106 and to a driving power supply fed with a power via the power switch 107 or the output contact 108*b* of the power supply relay 108*a*. Power conduction through the open/close element 130 is conducted and controlled by the mentioned power supply control circuit 126. Numeral 131 is a transistor for driving the mentioned power supply relay 108*a*, and numeral 132*a* is a drive resistor for turning on the transistor 131 via the power switch 107. Numeral 132*b* is a drive resistor for turning on the transistor 131 on the basis of a power supply relay drive output DR32 disposed in the mentioned logic circuit section 121.

In addition, when closing the power switch 107, the power supply relay 108*a* is energized via the drive resistor 132*a* and the transistor 131, and the output contact 108*b* of the power supply relay 108*a* is closed.

When the first integrated circuit element 110 and the second integrated circuit element 120 start their operation, as the transistor 131 is operated also by the power supply relay drive output DR32, even if the power switch 107 is opened thereafter, the drive resistor 132*b* keeps the power supply relay 108*a* operating until the power supply relay drive output DR32 is turned off. During the operation of the power supply relay 108*a*, the microprocessor carries out limp transaction and the actuator returns to the starting point.

Numeral 133 is a gate element connected between a load relay drive output DR31 of the logic circuit section 121 and the load relay 104*a*, and numeral 134 is a pull-down resistor connected to an input terminal of the gate element 133. Numeral IL1 is a first interlock signal that acts on the gate element 133 and stops the drive of the load relay 104*a* when the communication diagnostic output (the first mutual diagnostic output) ER1 or the control abnormality detection output CER generates an abnormality output and the logic level becomes "L". Numeral IL2 is a second interlock signal that changes the input logic level of the gate element 133 to "L" via the OR gate 129*b* and stops the drive of the load relay 104*a* when the abnormality storage element 129 is set.

Figure 2:
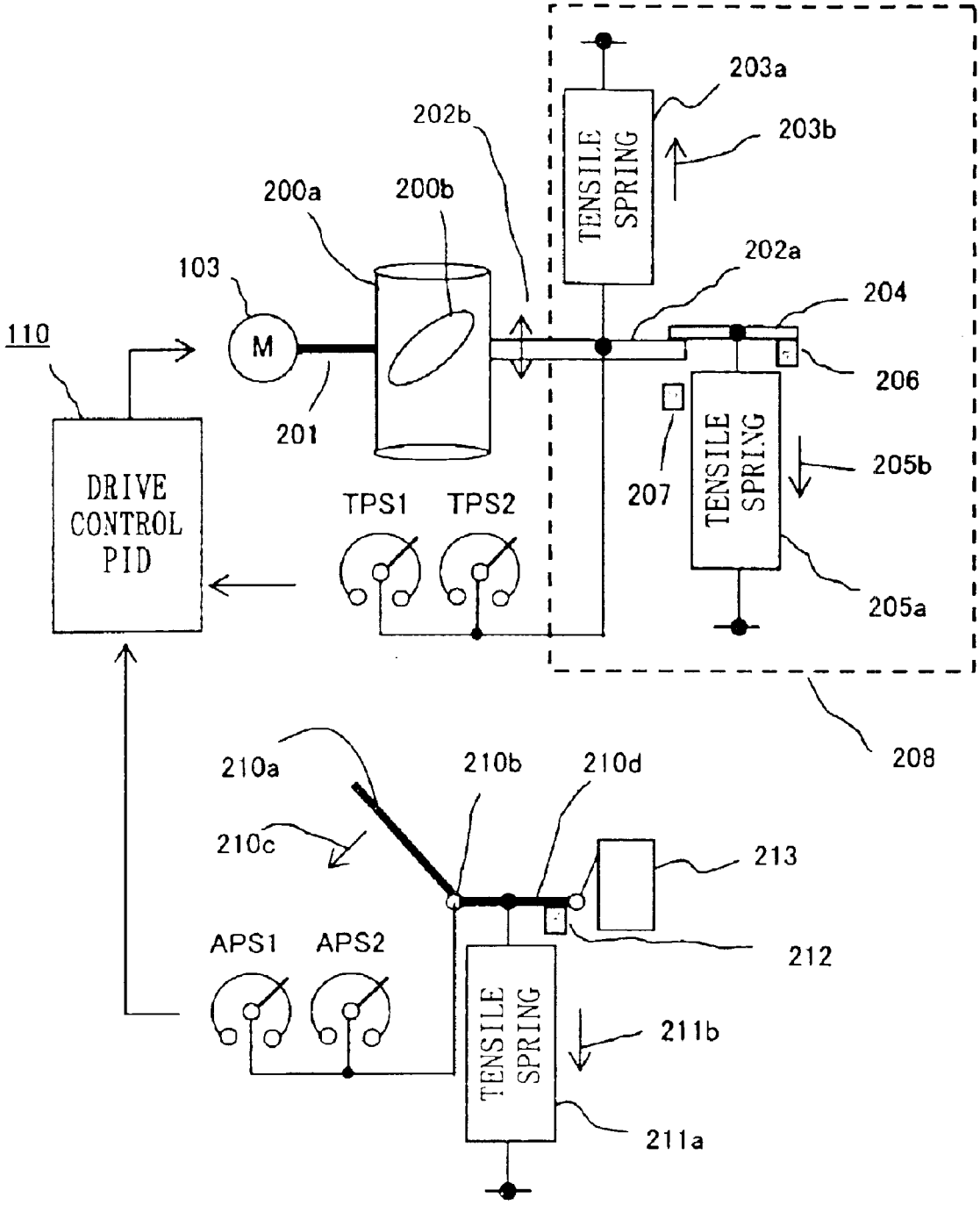
FIG. 2 is a schematic diagram for explaining a concept of a mechanism of the on-vehicle engine control apparatus according to Embodiment 1 of the invention.

FIG. 2 is a diagram for explaining a concept of a mechanism of an engine driven and controlled by the on-vehicle engine control apparatus according to Embodiment 1 shown in FIG. 1.

In FIG. 2, numeral 200*a* is an intake throttle provided with a throttle valve 200*b*, and numeral 201 is a rotary shaft of the motor 103 that controls opening and closing of the throttle valve 200*b*. Numeral 202*a* is an angular motion section that moves interlocking with the rotary shaft 201. In FIG. 2, this angular motion section 202*a* is illustrated so that the angular motion section 202*a* moves up and down in the direction of an arrow 202*b* for convenience of explanation.

Numeral 203*a* is a tensile spring urging the angular motion section 202*a* in the direction of an arrow 203*b* (valve-opening direction), and numeral 204 is a return member urged by a tensile spring 205*a* in the direction of an arrow 205*b* (valve-closing direction) and returning the angular motion section 202*a* toward the valve-closing direction resisting the tensile spring 203*a*. Numeral 206 is a default stopper for regulating the position to which the foregoing return member 204 returns, and numeral 207 is an idle stopper where the angular motion section 202*a* comes in contact when the angular motion section 202*a* is further driven toward the valve-closing direction from a situation in which the return member 204 is returned to the position of the default stopper 206.

The mentioned motor 103 controls the valve opening resisting the tensile spring 203*a* in the range from the default position to the idle stopper 207, and when the valve is opened beyond a default position, the motor 103 controls the valve opening working in cooperation with the tensile spring 203*a* and resisting the tensile spring 205*a*.

Accordingly, when interrupting the power supply of the motor 103, the angular motion section 202*a* closes or opens the valve up to a position where the return member 204 is regulated by the default stopper 206 due to the action of the tensile springs 205*a* and 203*a*, and this position is a valve opening position for limp driving in case of an abnormality.

However, it is necessary to assume that there may be a case where a valve opening is locked at an extremely large valve opening position, when occurring any actuator abnormality, i.e., when there is any abnormality in gear mechanism or the like and it is impossible to return the return member 204 to a target default position.

In addition, the first throttle position sensor (TPS 1) and the second throttle position sensor (TPS 2) are disposed so as to detect an operating position of the angular motion section 202*a*, i.e., throttle valve opening.

Numeral 208 is a default position return mechanism composed of the tensile springs 203*a* and 205*a*, the angular motion section 202*a*, the return member 204, the default stopper 206, and so on.

Numeral 210*a* is an accelerator pedal working in the direction of an arrow 210*c* with a fulcrum 210*b* as a center, and numeral 210*d* is a coupling member that is urged in the direction of an arrow 211*b* by a tensile spring 211*a* and drives the accelerator pedal 210*a* in the returning direction. Numeral 212 is a pedal stopper for regulating the return position of the accelerator pedal 210*a*, and numeral 213 is an idle switch for detecting a situation that the accelerator pedal 210*a* does not work and is returned to the position of the pedal stopper 212 by the tensile spring 211*a*. The first accelerator position sensor (APS 1) and the second accelerator position sensor (APS 2) are disposed to detect a degree of working of the accelerator pedal 210*a*.

In addition, a dc motor, a brushless motor, or a stepping motor or the like is used as the motor 103. In this embodiment, a direct-current motor under on-off ratio control is used as the motor 103, and this on-off ratio control is carried out by the microprocessor 111 incorporated in the first integrated circuit element 110.

Figure 3:
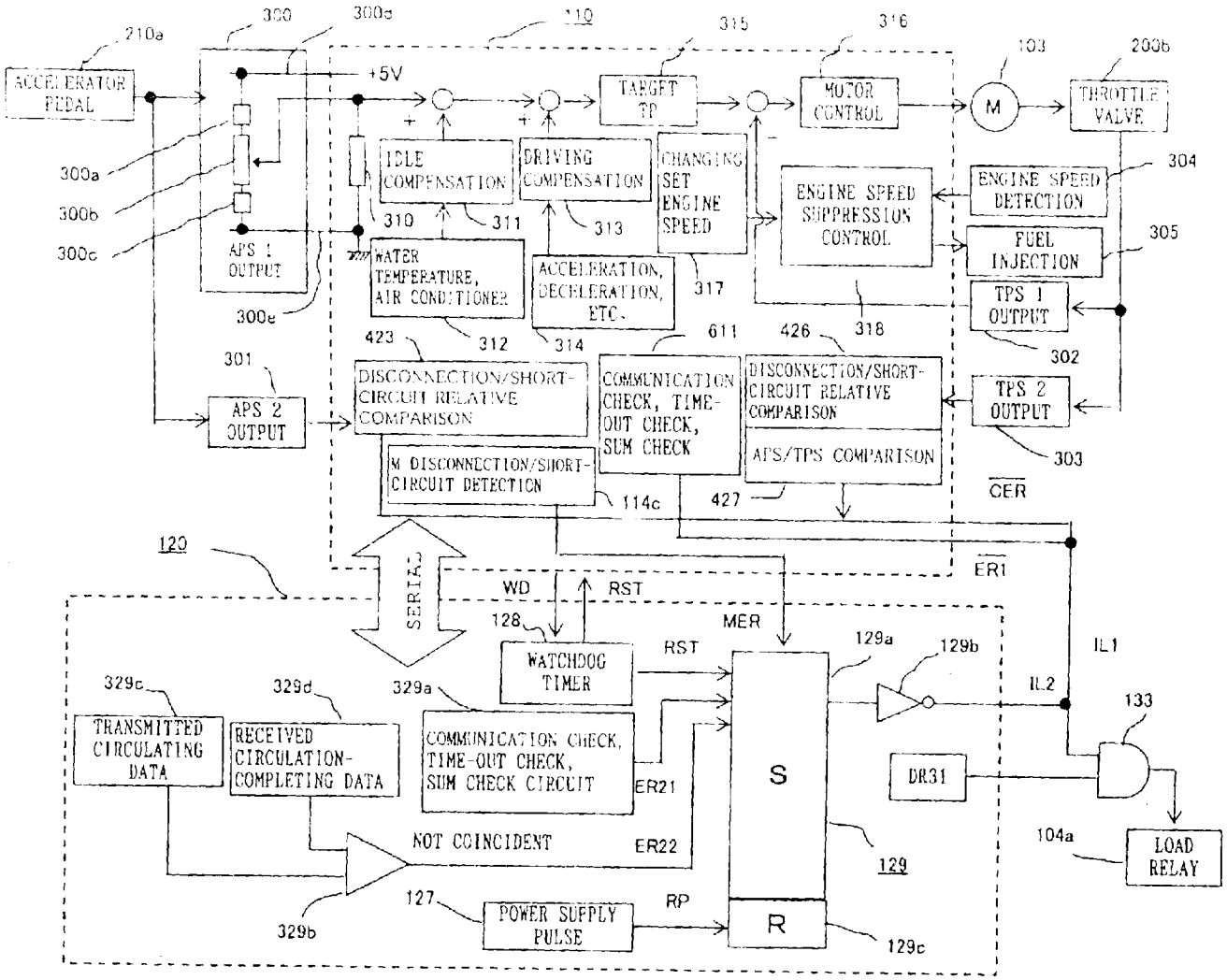
FIG. 3 is a block diagram for explaining the entire control operation of the on-vehicle engine control apparatus according to Embodiment 1 of the invention.

FIG. 3 is a block diagram for explaining the entire control operation of the on-vehicle engine control apparatus according to Embodiment 1.

In FIG. 3, the first accelerator position sensor (APS 1) and the second accelerator position sensor (APS 2) are indicated by numerals 300 and 301, and the first throttle position sensor (TPS 1) and the second throttle position sensor (TPS 2) working in connection with the throttle valve 200*b* are indicated by numerals 302 and 303.

As represented by the first accelerator position sensor (APS 1) of numeral 300, an internal constitution of those sensors is arranged such that, a series circuit composed of a positive resistor 300*a*, a variable resistor 300*b*, and a negative side resistor 300*c* is connected between positive/negative power supply lines 300*d* and 300*e*, and a detection output is taken out of a sliding terminal of the variable resistor 300*b*.

Therefore, the output voltages of the sensors are normally in the range of 0.2 to 4.8 V. However, there are some cases where any voltage outside the mentioned range is outputted if occurring any disconnection or short circuit in wiring, deficient connection in variable resistors, or the like.

In the first integrated circuit element 110, numeral 310 is a pull-down resistor for dropping input signal voltage to zero when a disconnection of a detection signal line, a deficient connection of the variable resistance 300*b*, or the like occurs, and numeral 311 is an idle compensation block for increasing an idle engine speed when any air conditioner is used or engine coolant temperature is low, and numeral 312 is a compensation factor signal for carrying out the mentioned idle compensation. The compensation factor signal is dependent on information inputted to the second A/D converter 113*b*.

Numeral 313 is a drive compensation block for increasing and decreasing a fuel supply amount depending on circumstances in which fuel supply is desired to be increased in order to improve acceleration performance when the accelerator pedal 210*a* is rapidly worked, and the fuel supply is desired to be suppressed for driving the vehicle stably at a constant speed. Numeral 314 is a compensation factor signal for carrying out the mentioned drive compensation, and in which the compensation factor signal is calculated in the microprocessor 111 on the basis of various factors such as speed of working the accelerator pedal 210*a* (differential value of an output signal of the APS 1).

Numeral 315 is a target throttle valve opening calculated in the microprocessor 111, and the target throttle valve opening 315 is obtained by algebraic addition of an increasing/decreasing compensation value calculated in the mentioned idle compensation block 311 or the drive compensation block 313 to an output signal voltage of the first accelerator position sensor (APS 1) conforming to a degree of working the accelerator pedal 210*a*.

Numeral 316 is a PID control section for carrying out on-off ratio control of the motor 103 so that an output signal voltage of the first throttle position sensor (TPS 1) corresponding to an actual throttle valve opening is coincident to a signal voltage of the target throttle valve opening 315.

Numeral 317 is a threshold value set engine speed described later, and numeral 318 is engine speed suppressing means that suppresses fuel supply using a fuel injection solenoid valve 305 so that an actual engine speed based on an engine speed detection sensor 304 may be equal to the mentioned threshold engine speed. The engine speed suppressing means 317 plays an important role in assuring safety when any abnormality occurs in the throttle control system as described later.

Numeral 114*c* is the disconnection/short-circuit detection circuit of the motor described above, and numeral 423 is first sensor abnormality detection means that detects any abnormality in the first accelerator position sensor (APS 1) and the second accelerator position sensor (APS 2) as described later referring to FIG. 4. Numeral 426 is second sensor abnormality detection means that detects any abnormality in the first throttle position sensor (TPS 1) and the second throttle position sensor (TPS 2) as described later referring to FIG. 4. Numeral 427 is loop abnormality detection means described later referring to FIG. 4, and numeral 611 is first mutual diagnostic means described later referring to FIG. 6.

In the second integrated circuit element 120, numeral 128 is a watchdog timer described above, and numeral 129 is an abnormality storage element composed of the set input section 129*a* and the reset input section 129*c*. Numeral 329*a* is a communication check circuit acting as one of the second mutual diagnostic means. The second integrated circuit element 120 checks operation of serial communication with the first integrated circuit element 110 as described later referring to FIG. 5. Numeral ER21 is a communication diagnostic output from the communication check circuit 329*a*, and numeral 329*b* is a comparison and judgment circuit acting as one of the second mutual diagnostic means and generating the mentioned circulation diagnostic output ER22.

Numeral 329*c* is a circulating data memory for storing circulating data for self-diagnosis transmitted from the second integrated circuit element 120 to the microprocessor 111 via the serial interfaces 125 and 115. Numeral 329*d* is a circulated (circulation-completed) data memory. After the microprocessor 111 has transmitted the circulating data to the various memories in the first integrated circuit element 110, circulation-completed data sent back to the second integrated circuit element via the serial interfaces 115 and 125 are stored in the circulation-completed data memory 329*d*. The comparison and judgment circuit 329*b* judges whether or not contents of the circulating data memory 329*c* are coincident to those of the circulation-completed data memory 329*d*.

Figure 4:
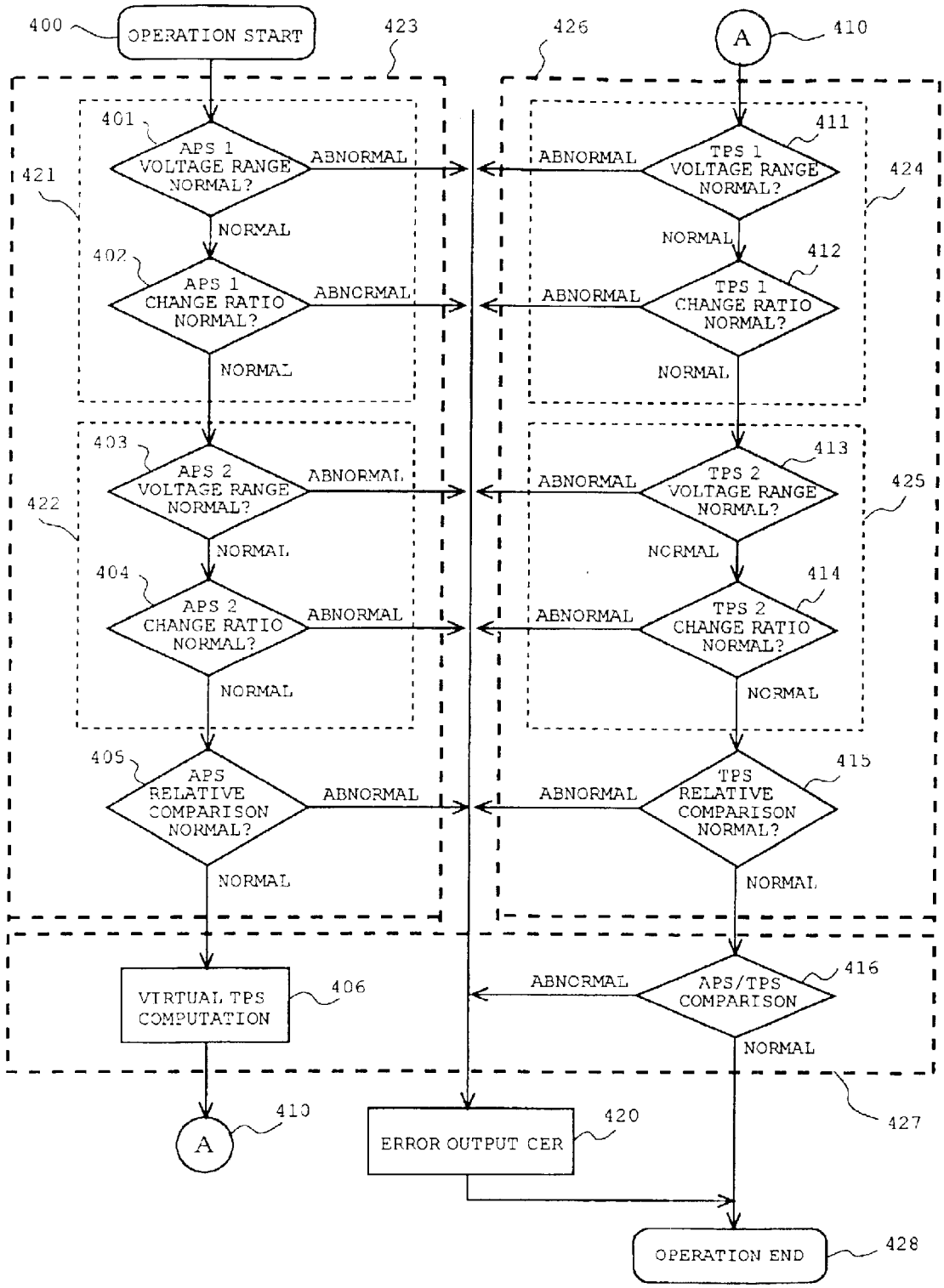
FIG. 4 is an abnormality detection flowchart for explaining operation of detecting an abnormality of the on-vehicle engine control apparatus according to Embodiment 1 of the invention.

FIG. 4 is an abnormality detection flowchart for explaining abnormality-detecting operation in the on-vehicle engine control apparatus according to Embodiment 1 shown in FIG. 1.

First, the manner of generating the control abnormality detection output CER detected by the microprocessor 111 is hereinafter described with reference to the flowchart shown in FIG. 4.

In FIG. 4, numeral 400 is a step of starting operation of the microprocessor 111 activated through interruption at a regular interval, and this operation start step 400 is followed by a step 401 of judging an output voltage range abnormality of the APS 1. The judgment step 401 judges the output voltage of the APS 1 normal in the range from 0.2 to 4.8 V and further judges whether or not there is any disconnection or a deficient connection in detection signal line or a short circuit or erroneous contact with different-voltage wiring such as positive/negative power supply line.

Numeral 402 is a step that operates when the result of judgment in step 401 is normal and judges an abnormality concerning an output voltage change ratio of the APS 1. In this abnormality judgment step 402, a change ratio is measured on the basis of a difference between an output voltage read out previous time and an output voltage read this time, and if the voltage changes abruptly beyond the normal limit, it is judged that there is any abnormality caused by the mentioned disconnection/short-circuit, or the like.

Numerals 403 and 404 are steps of judging an abnormality in the APS 2 in the same manner as the steps 401 and 402. Numeral 405 is a step that operates when the judgment result in step 404 is normal, and relatively compares whether or not an output voltage of the APS 1 is coincident to an output voltage of the APS 2 within a range of predetermined error. When the error between the output voltages is large, it is judged in step 405 that there is any abnormality. Numeral 406 is virtual throttle position computing means that operates when the judgment result in step 405 is normal. This virtual throttle position computing means 406 computes an output signal of a virtual throttle position sensor conforming to a current signal of the accelerator position sensor on the basis of a transfer function of the actuator system for throttle control. Numeral 410 is a junction terminal of a flow.

Numerals 411 and 412 are steps of judging an abnormality in the TPS 1 in the same manner as the foregoing steps 401 and 402. Numerals 413 and 414 are steps of judging an abnormality in the TPS 2 in the same manner as the steps 401 and 402. Numeral 415 is a step that operates when the judgment result in step 414 is normal. In this step 415, a relative comparison is made whether or not the output voltage of the TPS 1 is coincident to the output voltage of the TPS 2 within a predetermined error. When the error between the output voltages is large, it is judged that there is any abnormality. Numeral 416 is a judgment step that operates when the judgment result in step 415 is normal. In this step 416, it is judged that there is any control abnormality when the error is at least a predetermined value by comparing a virtual throttle valve opening computed in step 406 with the output voltage of the TPS.

Numeral 420 is an abnormality output step that operates when there is any abnormality in any of the judgment steps 401 to 405 and 411 to 416 and generates the control abnormality detection output CER in FIG. 1 and FIG. 3. When completing the operation in the output step 420 or when judging all the judgment steps normal, the process goes on to an end step 428, and waiting in step 428 continues until the start step 400 is activated again.

Numeral 421 is disconnection/short-circuit abnormality detection means of the APS 1 composed of the mentioned steps 401 and 402, and numeral 422 is disconnection/short-circuit abnormality detection means a of the APS 2 composed of the steps 403 and 404. Numeral 423 is the first sensor abnormality detection means composed of the steps 401 to 405, and numeral 424 is disconnection/short-circuit abnormality detection means of the TPS 1 composed of the steps 411 and 412. Numeral 425 is disconnection/short-circuit abnormality detection means of the TPS 2 composed of the steps 413 and 414, and numeral 426 is the second sensor abnormality detection means composed of the steps 411 to 415. Numeral 427 is loop abnormality detection means composed of the steps 406 and 416.

Now, serial communication between the first integrated circuit element 110 and the second integrated circuit element 120 is hereinafter described with reference to a diagram shown in FIGS. 5 (*a*), (*b*) and (*c*) are block diagrams each for explaining communication operation.

Figure 5A:
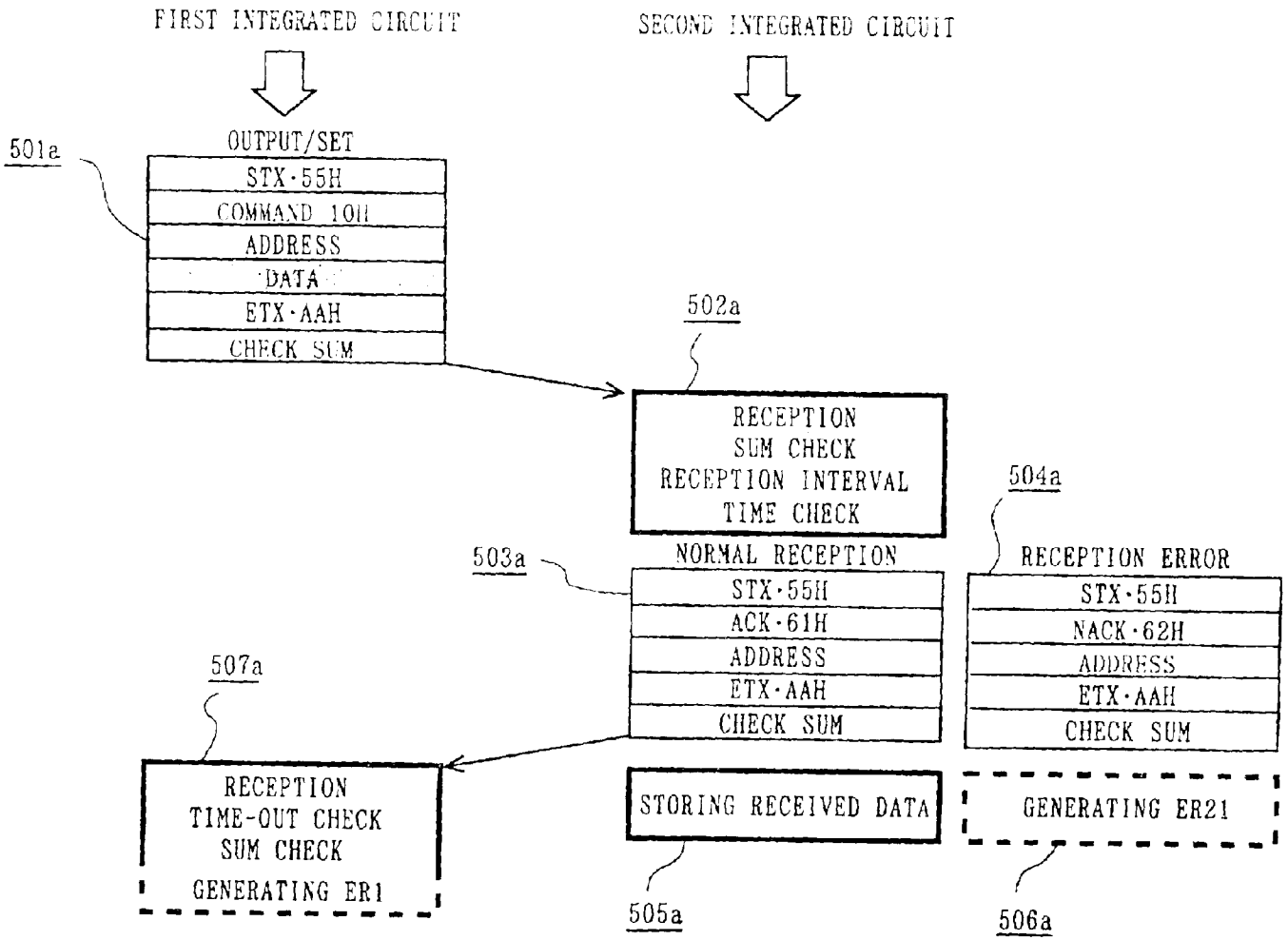
FIGS. 5 (*a*), (*b*) and (*c*) are block diagrams each for explaining communication operation in the on-vehicle engine control apparatus according to Embodiment 1 of the invention.
Figure 5B:
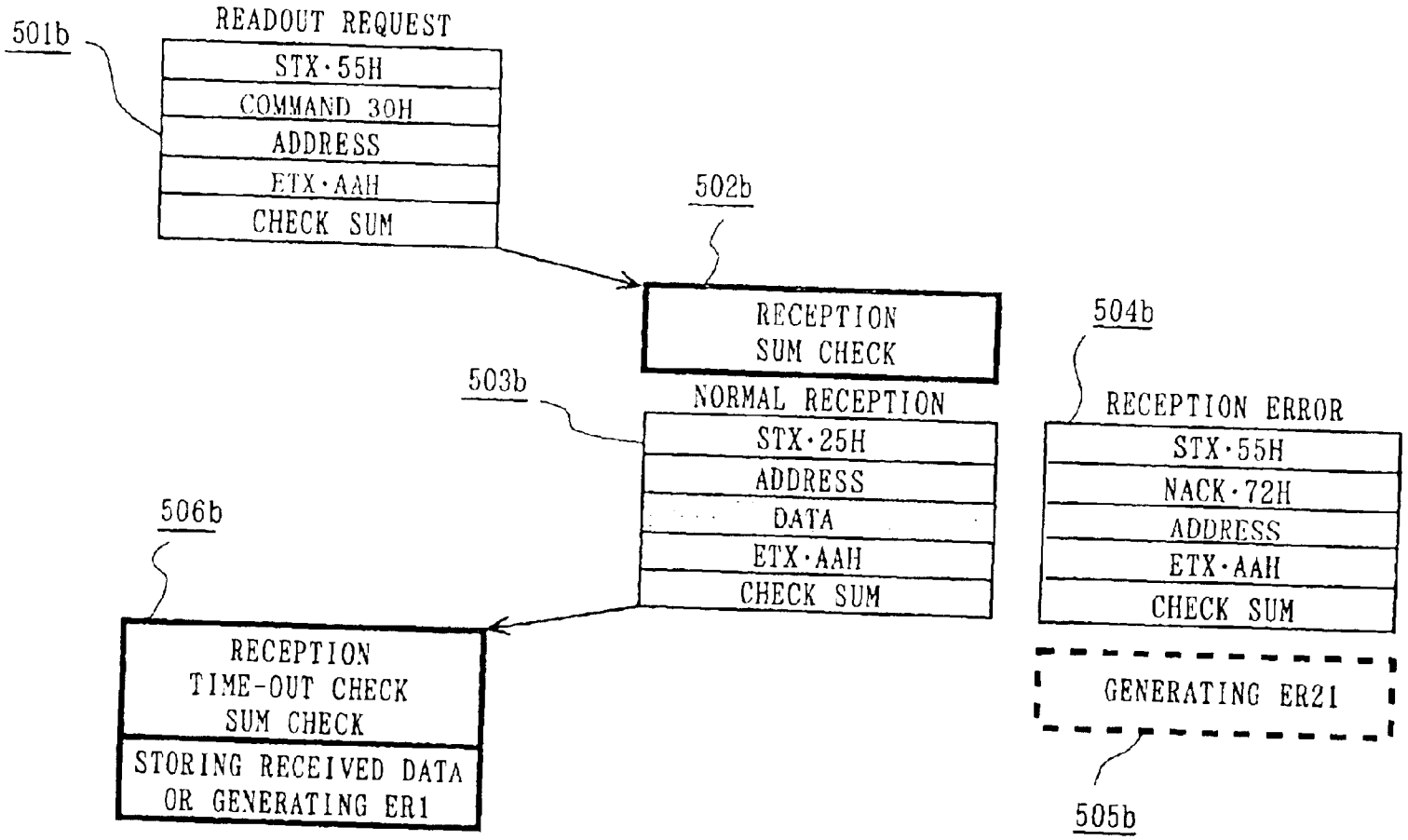
Figure 5C:
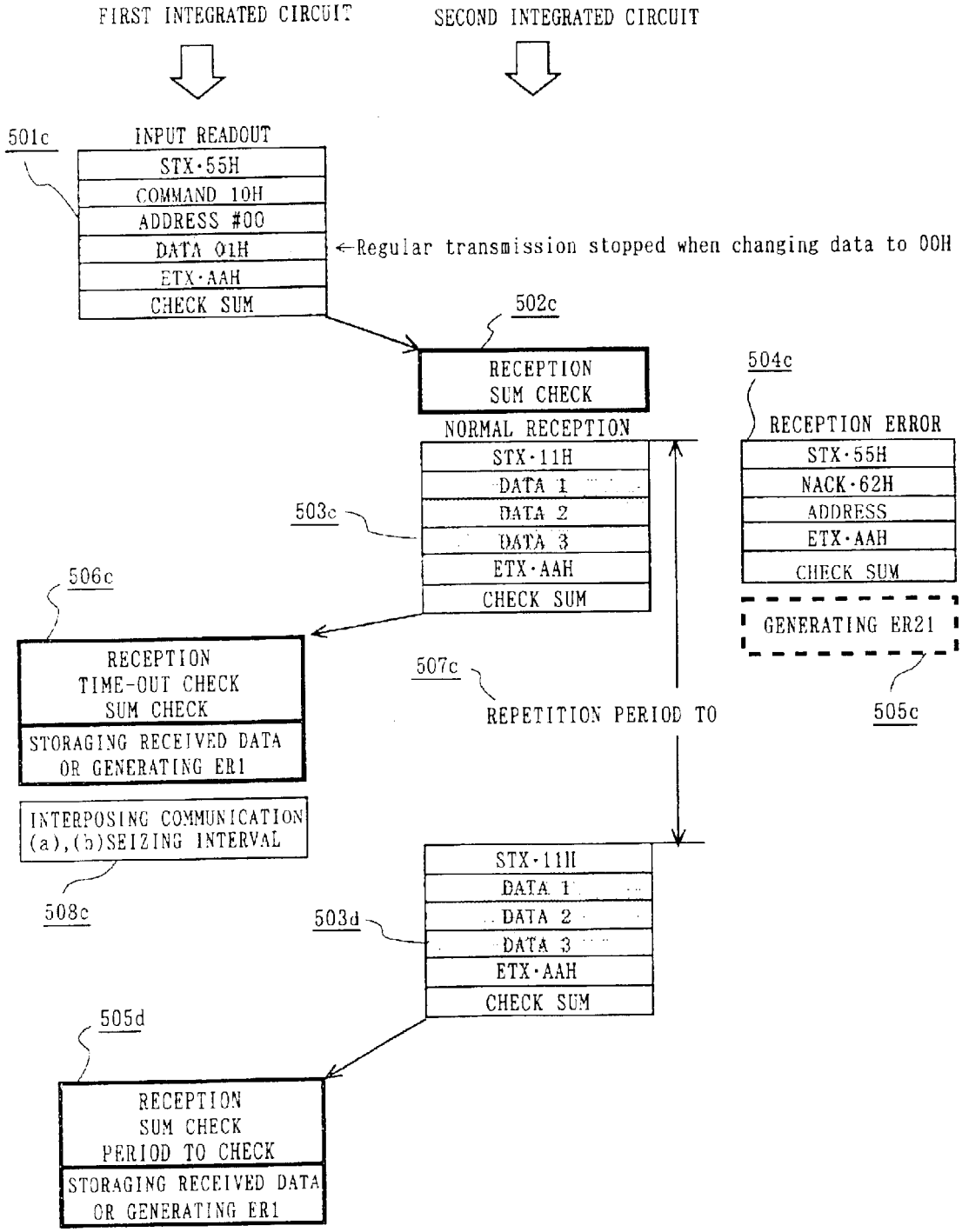

FIG. 5 (*a*) shows a frame constitution in a case of transmitting, for example, an auxiliary machinery drive output DR33 from the first integrated circuit element 110 (master station) to the second integrated circuit element 120 (substation).

In FIG. 5 (*a*), numeral 501*a* is a regular transmission frame transmitted from the master station to the substation, and the regular transmission frame 501*a* transmitted from the master station to the substation is composed of start data 55H, command 10H, a storage destination address, transmission data, end data AAH, and check sum data.

Numeral 502*a* is a judgment block where the second integrated circuit element 120 receives a series of data of the regular transmission frame 501*a*, and the communication check circuit 329*a* in FIG. 3 carries out sum check and time-out check of intervals at which the data are received.

Numeral 503*a* is a normal reply frame sent back to the master station when the judgment block 502*a* judges a reception as being normal. This normal reply frame is composed of start data 55H, recognition data 61H, storage destination addresses, end data AAH, and check sum data.

Numeral 504*a* is an abnormality reply frame sent back to the master station when the judgment block 502*a* judges a reception as being abnormal. This abnormality reply frame is composed of start data 55H, non-recognition data 62H, storage destination addresses, end data AAH, and check sum data.

Numeral 505*a* is a block where the received auxiliary machinery drive output DR33 is stored in a memory in the logic circuit section 121 and the peripheral auxiliary machinery 105*b* is driven after the normal reply frame 503*a* is sent back.

Numeral 506*a* is a block where the communication-check circuit 329*a* generates the communication diagnostic output ER21 after the abnormality reply frame 504*a* is sent back. In practical use, the communication diagnostic output ER21 is generated after a retransmission confirmation processing not shown.

Numeral 507*a* is a diagnostic block for carrying out sum check when the master station received the normal reply frame 503*a* or the abnormality reply frame 504*a* sent back by the substation or carrying out time-out check of reply response when the master station failed to receive the reply frame 503*a* or 504*a*. In a case where a diagnostic result in the diagnostic block 507*a* is abnormal or in a case where the abnormality reply frame 504*a* is received as being normal, the regular transmission frame 501*a* is transmitted again, and if any abnormality still continues, the communication diagnostic output ER1 (first mutual diagnostic output) is generated.

FIG. 5 (*b*) shows a frame constitution when the first integrated circuit element 110 (master station) requests the second integrated circuit element 120 (the substation) to read out various data (readout from the substation to the master station).

In FIG. 5 (*b*), numeral 501*b* is an irregular transmission frame transmitted from the master station to the substation. The irregular transmission frame 501*b* is composed of start data 55H, command 30H, readout destination addresses, end data AAH, and check sum data.

Numeral 502*b* is a judgment block where the second integrated circuit element 120 receives a series of data of the irregular transmission frame 501*b* and the communication check circuit 329*a* in FIG. 3 carries out sum check.

Numeral 503*b* is a normal reply frame sent back to the master station when the judgment block 502*b* judges the reception as being normal. The normal reply frame is composed of start data 25H, readout destination addresses, readout data, end data AAH, and check sum data.

Numeral 504*b* is an abnormality reply frame sent back to the master station when the judgment block 502*b* judges the reception as being abnormal. The abnormality reply frame is composed of start data 55H, non-recognition data 72H, readout destination addresses, end data AAH, and check sum data.

Numeral 505*b* is a block where the communication-check circuit 329*a* generates the communication diagnostic output ER21 after the abnormality reply frame 504*b* is sent back. In practical use, the communication diagnostic output ER21 is generated after a retransmission confirmation proceeding not shown.

Numeral 506*b* is a diagnostic block for carrying out sum check when the master station received the normal reply frame 503*b* or the abnormality reply frame 504*b* sent back by the substation or carrying out time-out check of reply response when the master station failed to receive the normal reply frame 503*b* or the abnormality reply frame 504*b*. In a case where the diagnostic result of the diagnostic block 506*b* is abnormal or the abnormality reply frame 504*b* is received as being normal, the irregular transmission frame 501*b* is transmitted again, and if the abnormality still continues, the communication diagnostic output ER1 (first mutual diagnostic output) is generated.

When the diagnostic block 506*b* received the normal reply frame 503*b* as being normal, the received data read out as being normal are stored in a memory of a predetermined address.

FIG. 5(*c*) shows a frame constitution in a case where the second integrated circuit element 120 (substation) transmits, for example, an input signal from the second on-off input sensor group 101*b* to the first integrated circuit element 110 (master station).

In FIG. 5(*c*), numeral 501*c* is an authorization transmission frame transmitted from the master station to the substation. The authorization transmission frame 501*c* is composed of start data 55H, command 10H, storage destination addresses #00, transmission data 01H, end data AAH, and check sum data.

Numeral 502*c* is a judgment block where the second integrated circuit element 120 receives a series of data of the authorization transmission frame 501*c* and the communication check circuit 329*a* in FIG. 3 carries out sum check.

Numeral 503*c* is a normal reply frame sent back to the master station when the judgment block 502*c* judges the reception as being normal. The normal reply frame is composed of start data 11H, data 1, data 2, data 3, end data AAH, and check sum data.

Numeral 504*c* is an abnormality reply frame sent back to the master station when the judgment block 502*c* judges the reception as being abnormal. The abnormality reply frame is composed of start data 55H, non-recognition data 62H, a storage destination address, end data AAH, and check sum data.

Numeral 505*c* is a block where the communication-check circuit 329*a* generates the communication diagnostic output ER21 after the abnormality reply frame 504*c* is sent back. In practical use, the communication diagnostic output ER21 is generated after the retransmission confirmation proceeding not shown.

Numeral 506*c* is a diagnostic block for carrying out sum check when the master station received the normal reply frame 503*c* or the abnormality reply frame 504*c* sent back by the substation or carrying out time-out check of reply response when the master station failed to receive the normal reply frame 503*c* or the abnormality reply frame 504*c*. In a case where the diagnostic result of the diagnostic block 506*c* is abnormal or the abnormality reply frame 504*c* is received as being normal, the authorization transmission frame 501*c* is transmitted again. If any abnormality still continues, the communication diagnostic output ER1 (first mutual diagnostic output) is generated.

In a case where the diagnosis block 506*c* received the normal reply frame 503*c* as being normal, the data 1, the data 2, and the data 3 that were normally read out are stored in a memory of a predetermined address.

Unless the data of the authorization transmission frame 501*c* are changed to 00H and transmitted from the master station to the substation, a continuous reply is repeatedly transmitted at intervals of a repetition period T0 shown in 507*c*.

Numeral 503*d* is a continuous reply frame, and its constitution is the same as that in the mentioned normal reply frame 503*c*.

Numeral 505*d* is a diagnostic block where the master station receives the continuous reply frame 503*d* sent back by the substation and sum check and time-out check of the repetition period T0 are carried out. In a case where the diagnostic result of the diagnostic block 505*d* is abnormal, the next continuous reply frame 503*d* is diagnosed, and if any abnormality still continues, the communication diagnostic output ER1 (first mutual diagnostic output) is generated.

In a case where the diagnostic block 505*d* received the continuous reply frame 503*d* as being normal, the data 1, the data 2, and the data 3 normally read out are stored in a memory of a predetermined address.

The regular transmission frame 501*a* and the irregular transmission frame 501*b* are also transmitted seizing an interval between the continuous replies from the substation to the master station as indicated by 508*c*.

Figure 6:
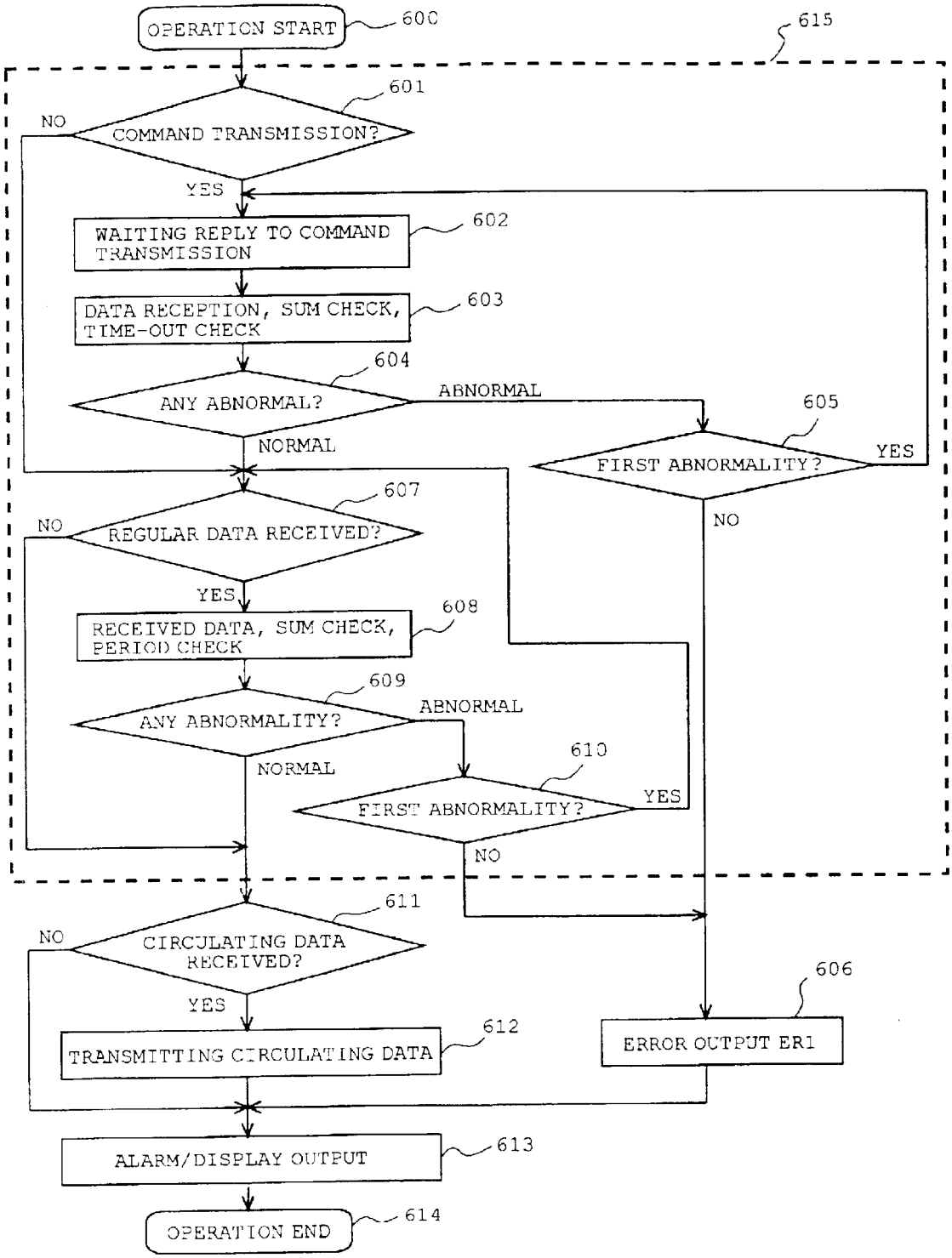
FIG. 6 is a flowchart for explaining communication check operation of the on-vehicle engine control apparatus according to Embodiment 1 of the invention.

FIG. 6 is a communication check flowchart for explaining communication operation (mutual diagnostic operation) of the on-vehicle engine control apparatus according to Embodiment 1 shown in FIG. 1.

In FIG. 6, numeral 600 is a start step for starting operation of the microprocessor 111 activated by interruption at regular intervals. This step 600 is followed by a judgment step 601 for judging whether or not it is necessary to transmit a command. In this judgment step 601, it is judged whether or not it is timing for transmitting the regular transmission frame 501*a*, the irregular transmission frame 501*b*, and the authorization transmission frame 501*c* shown in FIG. 5.

Numeral 602 is a waiting step that operates when it is judged in the judgment step 601 that it is over time for the transmission. In this step 602, any of the mentioned regular transmission frame 501*a*, the irregular transmission frame 501*b*, and the authorization transmission frame 501*c* shown in FIG. 5 is transmitted, and a reply response from the substation is being waited. The waiting step 602 is followed by a step 603 where reply data are received and sum check and time-out check are carried out.

The step 603 is followed by a step 604 for judging whether or not there is any abnormality in step 603 and acts as first means for checking communication. Numeral 605 is a step that operates when it is judged in step 604 that there is any abnormality and judges whether or not the abnormality is a first abnormality. If it is judged that the abnormality is the first abnormality in the step 605, the process goes on to step 602 and a command is transmitted again. If the abnormality occurred after the retransmission (abnormality is not the first abnormality), the process goes on to a step 606 for generating the communication diagnostic output ER1.

Numeral 607 is a step that operates when the judgment result is NO in the judgment step 601, when the judgment result is normal in the judgment step 604, or when the judgment result in a step 610 described later is YES, and judges whether or not any of the frames 503*c*, 504*c*, and 503*d* in FIG. 5 has been received.

Numeral 608 is a step that operates when the judgment result in step 607 is YES and acts as second means for checking communication, in which sum check and time-out check of the received data or period check are carried out. The step 608 is followed by a step 609 for judging whether or not there is any abnormality in step 608. Numeral 610 is a step that operates when it is judged that there is an abnormality in step 609 and judges whether or not the abnormality is the first abnormality. If it is judged that the abnormality is the first abnormality in step 610, the process goes on to step 607 to wait for reception of regular data, and If the abnormality occurred after the retransmission (abnormality is not the first abnormality), the process goes on to a step 606 for generating the communication diagnostic output ER1.

Numeral 611 is a step that operates when the judgment result in step 607 is NO or when the judgment result in step 609 is normal, and judges whether or not circulating data stored in the circulating data memory 329*c* in FIG. 3 have been received. Numeral 612 is a step that operates when the judgment result in step 611 is YES, and after transmitting the circulating data to the memories of various sections, the circulating data are transmitted to the circulation-completed data reception memory 329*d* shown in FIG. 3. Numeral 613 is a step that operates when the judgment result in step 611 is NO or acts following the step 612 or 606. This step 613 serves as alarm/display output means that generates an alarm/display output to the alarm/display devices 109 (see FIG. 1) on the basis of the error contents of the communication diagnostic output 606 or the contents of the control abnormality detection output 420 shown in FIG. 4.

The step 613 is followed by a end step 614 for ending operation and waiting in step 614 continues until the start step 600 is activated again.

Numeral 615 is first mutual diagnostic means that includes the step 603 acting as the first means for checking communication and the step 608 acting as the second means for checking communication.

Each operation referring to FIGS. 1 to 3 has been described above in association with description of constitution. Now, description mainly about the manner of sharing functions between the first integrated circuit element 110 and the second integrated circuit element 120 is hereinafter described.

First, the first integrated circuit element 110 drives the motor 103 with the first control output DR1 on the basis of input signals from various sensors such as the first and second on-off input sensor groups 101*a* and 101*b* or the first and second analog input sensor groups 102*a* and 102*b*, or drives the engine drive 105*a* and the peripheral auxiliary machinery 105*b* with the second and third control outputs DR2 and DR33.

The input signals of low-speed and low frequency operation from the second on-off input sensor group 101*b* and the third control output DR33 to the peripheral auxiliary machinery 105*b* are inputted and outputted by the serial interfaces 115 and 125 via the second integrated circuit element 120. Consequently, number of input/output pins of the first integrated circuit element 110 is reduced and it is possible to miniaturize the first integrated circuit element 110.

As a further function sharing, various abnormality judgments and the manner of handling results of judgment are important.

In FIG. 1, four kinds of abnormality detection inputs are connected to the set input section 129*a* of the abnormality storage element 129.

First, any abnormality in the first integrated circuit element 110 diagnosed by the second integrated circuit element 120 is outputted as the second mutual diagnosis output including the reset output RST, the communication diagnostic output ER21, and the circulation diagnostic output ER22, and all of them are stored in the abnormality storage element 129.

In the same manner, an abnormality in the motor 103 is stored as the circuit abnormality detection output MER based on the disconnection/short-circuit abnormality detection circuit 114*c*. When any abnormality is stored in the abnormality storage element 129, the load relay 104*a* is interrupted via the gate element 133, and the load relay 104*a* is not reset until the power switch 107 is turned on again.

On the other hand, an abnormality in the second integrated circuit element 120 diagnosed by the first integrated circuit element 110 acts on the gate element 133 as the first mutual diagnostic output ER1 and interrupts the load relay 104*a*.

The accelerator position sensors and the throttle position sensors are checked by the first and second sensor abnormality detection means 423 and 426 (see FIG. 4). Any abnormality in the entire control system including an abnormality in the actuator is checked by the loop abnormality detection means 427 (see FIG. 4), acts on the gate element 133 in the form of the control abnormality detection output CER, and interrupts the load relay 104*a*.

A throttle valve opening/closing mechanism is provided with a default position return mechanism 208 (see FIG. 2) for safety, and its mechanical abnormality is checked by the loop abnormality detection means 427 (FIG. 4).

In the event of occurring any of those abnormalities, the alarm/display devices 109 is operated to warn the driver of the abnormality. At the same time, the load relay 104*a* is de-energized, thereby interrupting the power supply circuit of the motor 103, and the default position return mechanism 208 returns the throttle valve 200*b* to the default position.

On the other hand, under such a condition, the engine speed suppression means 318 (FIG. 3) suppresses the engine speed so as to be kept below a predetermined threshold value, and limp driving is carried out conforming to a degree of working the brake pedal.

In a case where the microprocessor 111 runs out of control caused by a temporary noise malfunction or the like, the microprocessor 111 itself is automatically reset and restarted, thereby recovering its normal operation. Note that even in this case, the abnormality storage element 129 stores the abnormality operation, the alarm/display device 109 works and the throttle valve 200*b* is returned to the default position.

However, when the power switch 107 is once turned off and then turned on again, the abnormality storage element 129 is reset by the power supply detection pulse output RP and, consequently, the operation including the throttle control is restored to normal condition.

In case of occurring any abnormality which is not a mere temporary abnormality caused by a noise malfunction or the like, the abnormality is detected again and stored even after the abnormality storage element 129 is once reset by the power switch 107.

Embodiment 2.

Figure 7:
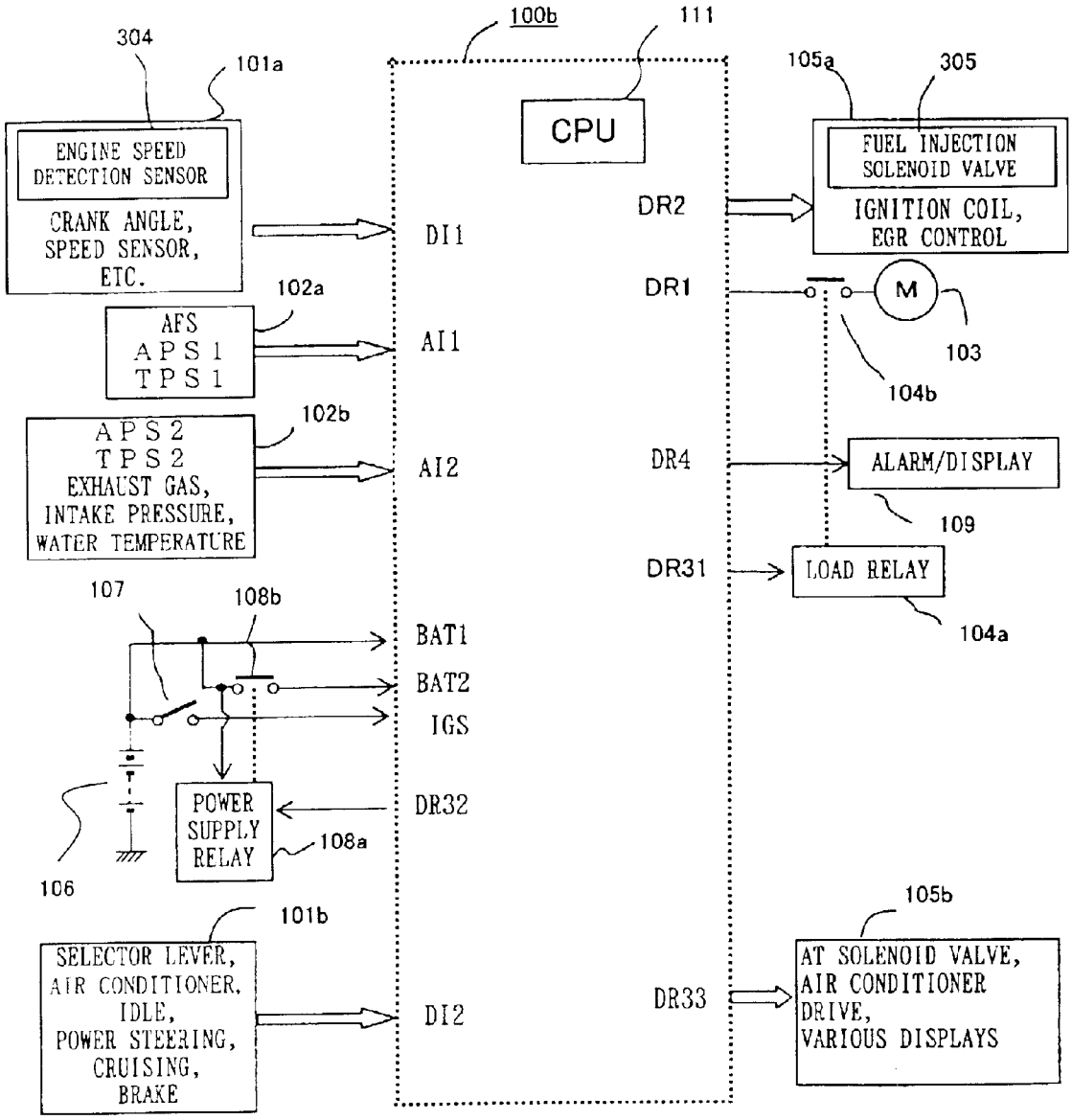
FIG. 7 is a block diagram for explaining a constitution of an on-vehicle engine control apparatus according to Embodiment 2 of the invention.

FIG. 7 is a block diagram for explaining a constitution of an on-vehicle engine control apparatus according to Embodiment 2 of the invention.

In FIG. 7, numeral 100*b* is an electronic control apparatus comprised of an electronic circuit board accommodated in a closed box member not shown, and is mainly composed of a microprocessor 111*b*. The electronic control apparatus is connected to external input/output equipment via a connector not shown.

Numeral 101*a* is a first group of on-off input sensors including a crank angle sensor, a vehicle speed sensor, and so on in addition to an engine speed detection sensor indicated by numeral 304. Input signals DI1 of those sensors are of high-speed and high frequency operation, in which it is required to read frequent on-off operation in a microprocessor at a high speed.

Numeral 101*b* is a second group of on-off input sensors including a transmission shift lever selective position sensor, an air conditioner switch, a switch for detecting an idle position of an accelerator pedal, a power steering operation switch, a cruise switch for constant-speed driving, and a brake switch. Input signals of those sensors are of low-speed operation and low frequency, in which delay in responding to the reading of on-off operation does not cause a serious problem.

Numeral 102*a* is a first group of analog input sensors including an airflow sensor (AFS) measuring a throttle intake amount, a first accelerator position sensor (APS 1) for measuring the degree of working the accelerator pedal, and a first throttle position sensor (TPS 1) for measuring the throttle valve opening. Numeral AI1 is first analog input signals. Numeral 102*b* is a second group of analog input sensors including a second accelerator position sensor (APS 2), a second throttle position sensor (TPS 2), an exhaust gas sensor, a coolant temperature sensor, and an intake pressure sensor. Numeral AI2 is second analog input signals. The mentioned APS 1 and APS 2 and the mentioned TPS 1 and TPS 2 are disposed double from the viewpoint of safety.

Numeral 103 is a motor for controlling opening and closing of the intake throttle valve driven by the first control output DR1. Numeral 104*a* is a load relay which is driven by the control output DR31, and feeds and cuts the power supply to the motor 103 via an output contact 104*b*. When operating the load relay 104*a*, the power supply circuit of the motor 103 is closed.

Numeral 105*a* is an engine drive that is driven by the second control output DR2. The engine drive 105*a* includes an engine ignition coil (in case of gasoline engine), a fuel injection solenoid valve indicated by numeral 305, and a solenoid valve for circulating and burning exhaust gas (or a stepping motor). Numeral 105*b* is a peripheral auxiliary machinery that is driven by the third control output DR33. the peripheral auxiliary machinery 105*b* includes a solenoid valve for changing gear of the transmission, an electromagnetic clutch for driving the air conditioner, and various display devices. Numeral 106 is an on-vehicle battery connected to a terminal BAT1.

Numeral 107 is a power switch such as an ignition switch connected to the on-vehicle battery 106 and a terminal IGS, and numeral 108*a* is a power supply relay provided with an output contact 108*b* connected to a terminal BAT2 and fed with power from the on-vehicle battery 106. Numeral DR32 is a power supply relay drive output for driving the mentioned power supply relay, and numeral 109 is alarm/display devices for throttle control driven by the control output DR4.

Figure 8:
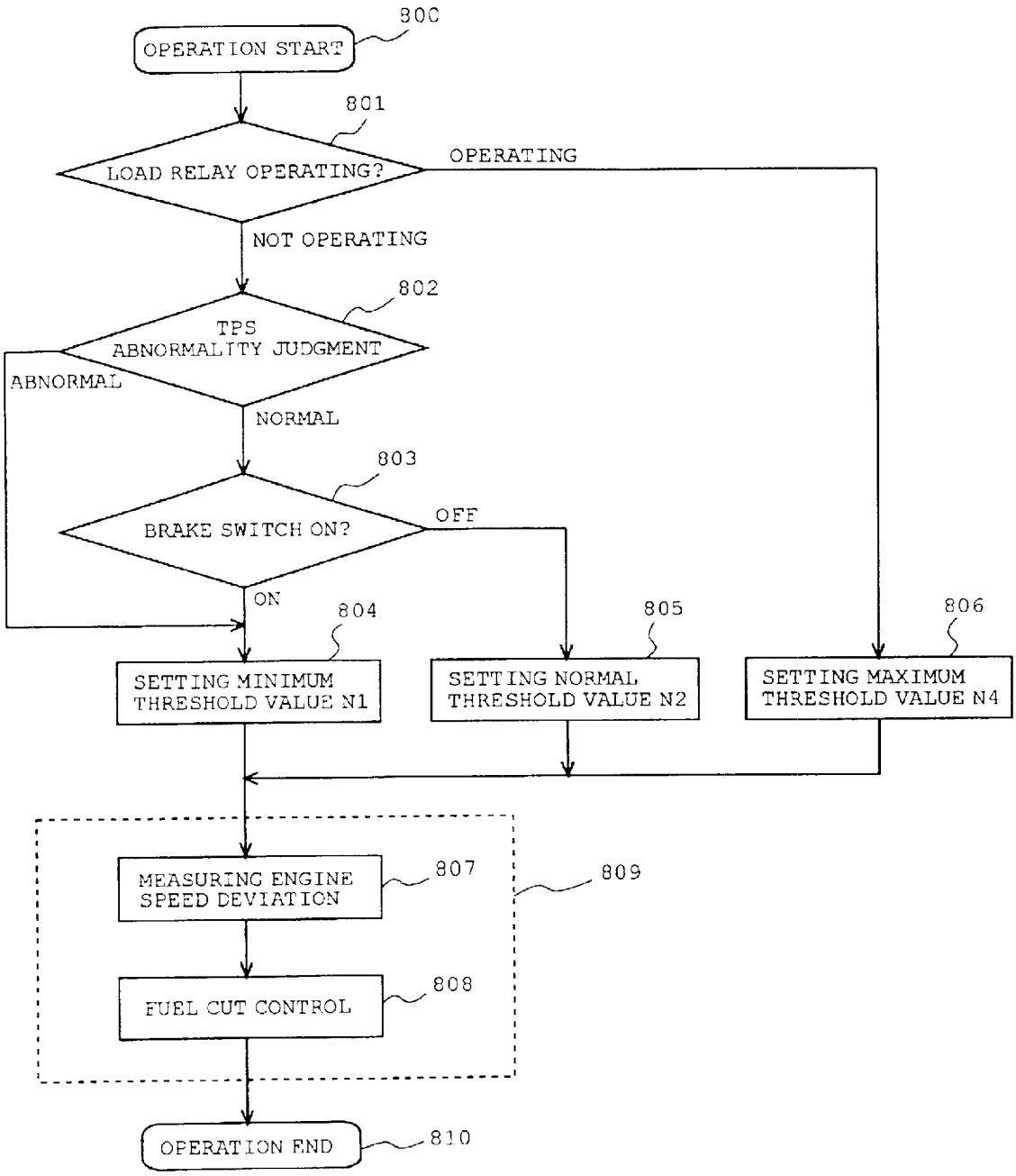
FIG. 8 is a flowchart for explaining operation of setting a threshold value of an engine speed in the on-vehicle engine control apparatus according to Embodiment 2 of the invention.

FIG. 8 is a threshold value setting flowchart for explaining operation of setting a threshold value of an engine speed in the on-vehicle engine control apparatus according to Embodiment 2 shown in FIG. 7.

In FIG. 8, numeral 800 is a start step for starting operation of the microprocessor 111*b* activated by interruption at regular intervals, and this step 800 is followed by a judgment step 801 for judging whether or not the load relay 104*a* is working. Numeral 802 is a step that operates when the load relay 104*a* is not working, and judges whether or not at least one of TPS 1 and TPS 2 is normal. Numeral 803 is a step that operates when at least one of the TPS 1 and the TPS 2 is normal, and judges whether or not an auxiliary brake is operated. Operation or release of the auxiliary brake is judged depending upon whether the brake switch is on or off.

Numeral 804 is minimum threshold value setting means that operates when both TPS 1 and the TPS 2 are judged as being abnormal in step 802 or when the auxiliary brake switch is on in step 803 and sets the engine speed limit to N1. Numeral 805 is normal threshold value setting means that operates when the auxiliary brake switch is off in step 803 and sets the engine speed limit to N2. Numeral 806 is maximum threshold setting value means that operates when the load relay 104*a* is working and sets the engine speed limit to N4.

For example, when N1=1000 rpm and N4=8000 rpm, N2 is a value obtained by calculation using the following equation:

$$N2=2500/[1+1.5\times(\theta p/\theta max)]\ (rpm)$$

where:

θp is a current throttle valve opening (θp=0 to θmax), and

θmax is the maximum valve opening (deg).

Accordingly, the minimum value of N2 is 1000 rpm when θp=θmax, and the maximum value of N2 is 2500 rpm when θp=0. When the default position return mechanism 208 shown in FIG. 2 is normally operating, the level of the current throttle valve opening is, for example, θp=0.05 θmax, and the threshold value N2 is 2325 rpm at this time.

Numeral 807 is a step for measuring a deviation between a threshold engine speed set in the steps 804 to 806 and an actual engine speed detected by the engine speed detection sensor 304 (see FIG. 7). Numeral 808 is fuel suppression and injection means that acts on the fuel injection solenoid valve 305 (see FIG. 7) on the basis of the deviation value and cuts fuel supply so that the engine speed is kept below the set threshold value. Numeral 809 is engine speed suppression means composed of steps 807 and 808, and numeral 810 is end step for ending the operation.

The mentioned engine speed suppression means 809 increases or decreases the number of idle cylinders in which fuel injection is stopped conforming to the speed deviation, or carries out fuel cut control in which fuel supply of all the engines is stopped if required when a load thereon is light. In this manner, the engine speed suppression means 809 suppresses the engine speed in order to prevent the engine speed from being excessively increased. However, when a load is heavy, the engine speed does not always reach the threshold value even if fuel is supplied to all the cylinders.

In a case where the threshold value is set as described above, under the normal conditions that the load relay 104*a* is working, the vehicle is driven in a range of engine speed not higher than the maximum engine speed authorized by the threshold value N4.

When the load relay 104*a* stops working, limp driving is carried out at not higher than the engine speed limited by the threshold value N2, and therefore the vehicle is stopped against the driving force of the engine by stepping on the brake hard.

However, when there is any abnormality in the throttle position sensors TPS and the throttle valve opening is unknown or when an auxiliary brake is applied to stop the vehicle, setting of the threshold value is changed so that the vehicle is easily stopped and held by lowering the threshold value to N1.

Figure 9:
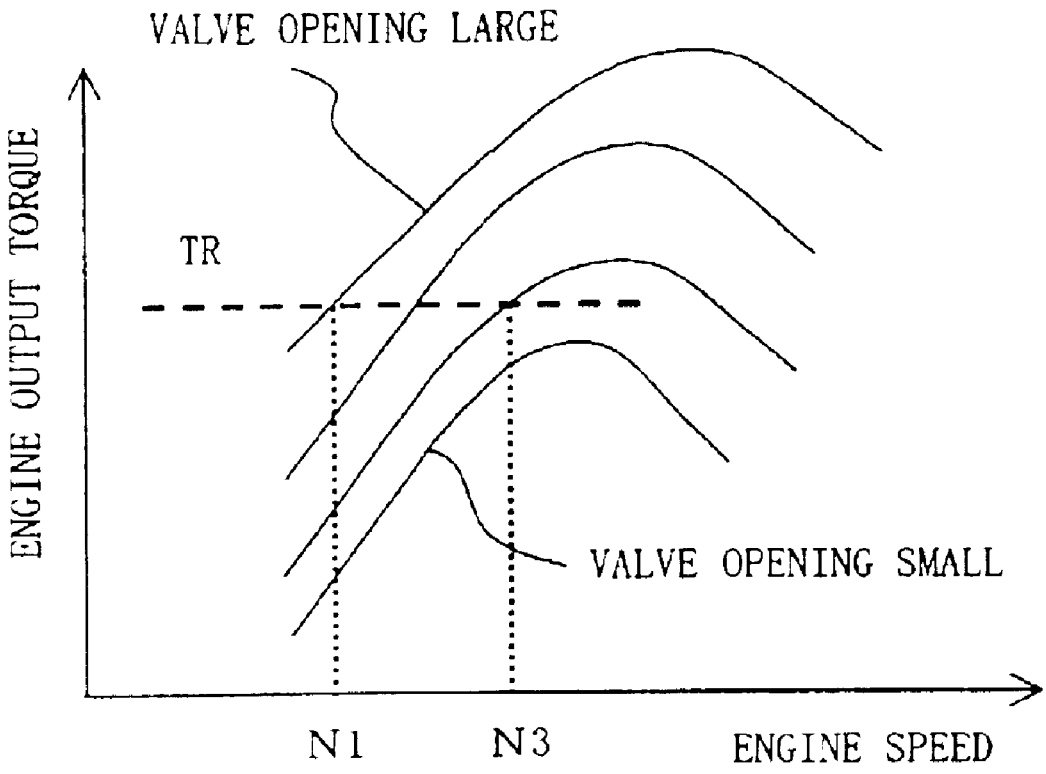
FIG. 9 is a graph for explaining torque characteristics of an engine.
Figure 10:
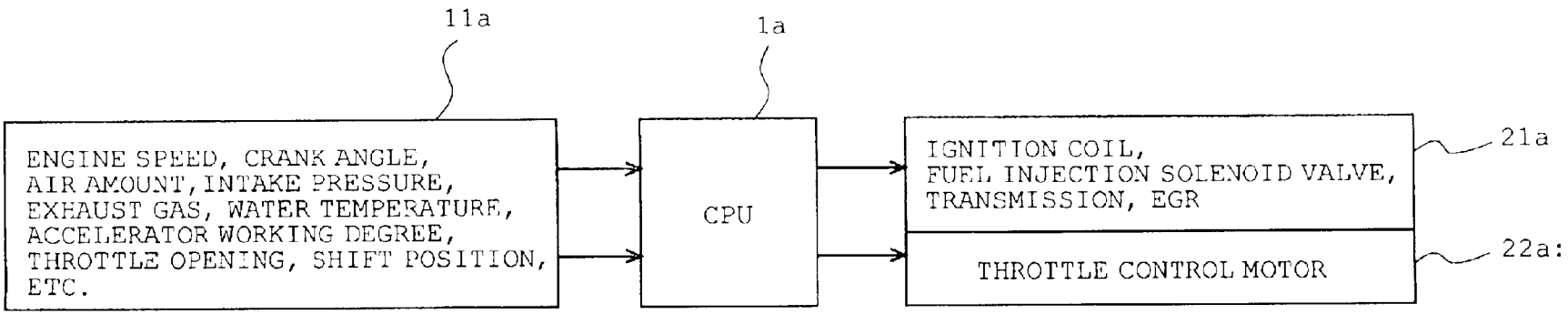
FIG. 10 is a diagram showing a constitution of a CPU according to a first type of conventional on-vehicle engine control apparatus.
Figure 11:
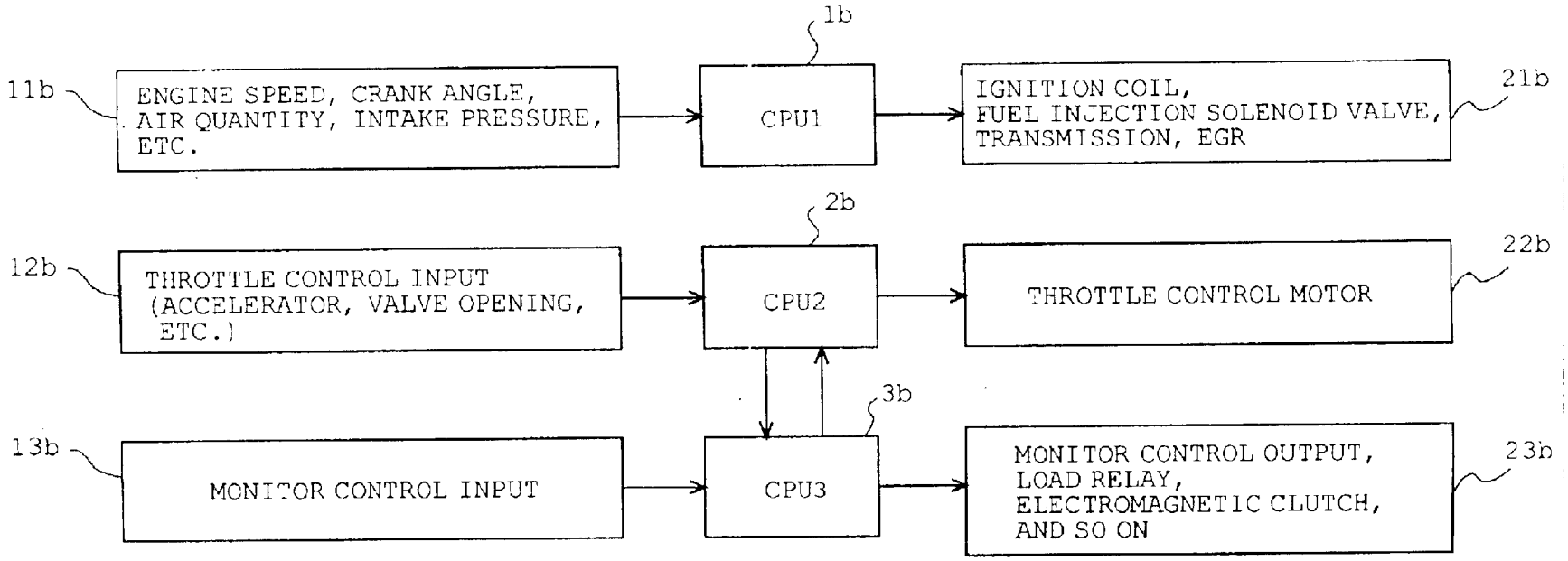
FIG. 11 is a diagram showing a Constitution of a CPU according to a second type of conventional on-vehicle engine control apparatus.
Figure 12:
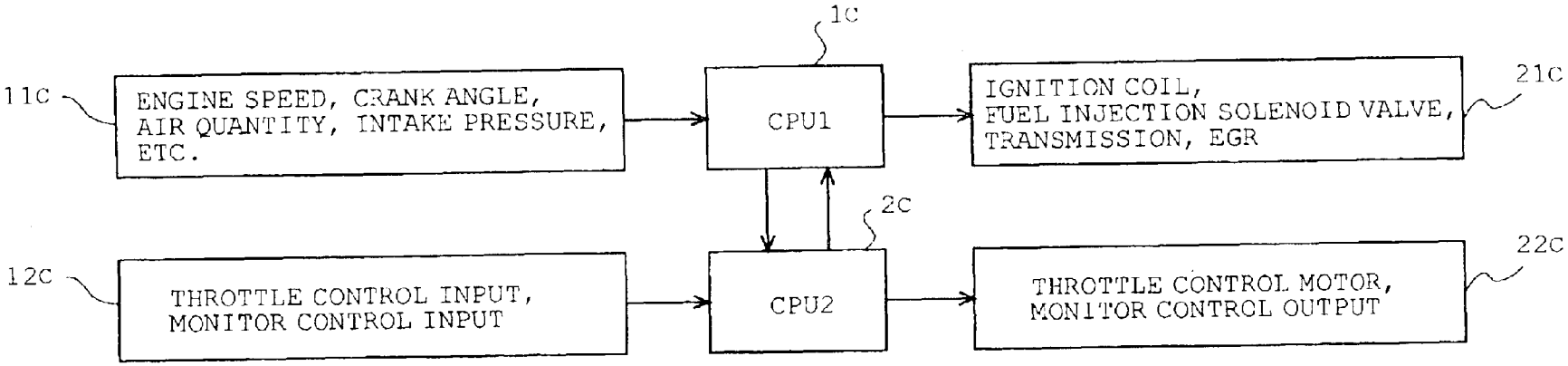
FIG. 12 is a diagram showing a Constitution of a CPU according to a third type of conventional on-vehicle engine control apparatus.

FIG. 9 is a graph showing an example of torque characteristics of the engine.

In FIG. 9, engine output torque indicated by the axis of ordinates shows an approximately secondary dimensional curve of convex-shape in relation to engine speed indicated by the axis of abscissas, and the maximum engine output torque grows larger as the throttle valve opening is larger.

Particularly in a region where the engine speed is low, the engine output torque is approximately in proportion to the engine speed.

Therefore, output torque of the engine is regulated to a level of a horizontal line TR in FIG. 9 by regulating the engine speed to be the low engine speed N1 when the throttle valve opening is large and regulating the engine speed to be the high engine speed N3 when the throttle valve opening is small.

A value obtained by the above expression is the upper limit of engine speed for approximately obtaining a certain constant output torque TR. Level of this output torque is selected so that the vehicle is easily stopped by stepping on the brake pedal and is driven with a light load by releasing the brake.

In addition, other than the manner of fetching inputs and outputs between the first integrated circuit element 110 and the second integrated circuit element 120 described in the foregoing Embodiment 1, various modifications are available.

For example, it is preferable that the second A/D converter 113*b* is disposed in the second integrated circuit element 120, and analog signals of low-speed operation from the second analog input sensor group 102*b* are read in the second integrated circuit element 120 and transmitted to the microprocessor 111 via the serial interfaces 125 and 115.

It is also preferable that the control output of the transmission solenoid valve, in which number of speeds is decided mainly as a function of a degree of working the accelerator pedal and vehicle speed, is directly outputted from the first integrated circuit element 110 side.

In other words, it is important to regard ignition control, fuel injection control and throttle control each closely related to the engine speed control as inseparable one control. Thus an integral control is carried out on the first integrated circuit element 110 side including the microprocessor 111, and the second integrated circuit element 120 is used in combination with the first integrated circuit element 110 to share and effectively perform the monitoring and controlling function.

It is also important that the serial interfaces 115 and 125 are used in transmitting and receiving signals between the first and second integrated circuit elements 110 and 120. Thus it is possible to add cooperative monitoring and controlling function without increase in number of pins of the first integrated circuit element 110.

Now, features and advantages of the on-vehicle engine control apparatus according to this invention are summarized with the inclusion of additional ones.

As a first feature, an on-vehicle engine control apparatus according to the invention includes: a motor for carrying out an intake throttle valve opening control conforming to an output of one of a pair of accelerator position sensors that detects a degree of working an accelerator pedal and an output of one of a pair of throttle position sensors that detects the mentioned throttle valve opening; and an engine drive that includes at least one fuel injection solenoid valve;

the mentioned on-vehicle engine control apparatus further including: a load relay that feeds the mentioned motor with a power supply and returns the mentioned throttle valve opening to a predetermined position by interrupting the mentioned power supply; a first integrated circuit element that includes a microprocessor and generates a first control output for controlling a throttle valve to the mentioned motor and a second control output to the mentioned engine drive; a second integrated circuit element that is connected to the mentioned first integrated circuit element via a serial interface and generates a driving output to the mentioned load relay in cooperation with the mentioned microprocessor of the mentioned first integrated circuit element; first mutual diagnostic means that is incorporated in the mentioned first integrated circuit element and diagnoses whether or not there is any abnormality in operation of the mentioned second integrated circuit element; second mutual diagnostic means that is incorporated in the mentioned second integrated circuit element and diagnoses whether or not there is any abnormality in operation of the mentioned first integrated circuit element; and abnormality detection means that monitors operation of a sensor system, a control system, and an actuator system related to the mentioned throttle valve control at all times and generates an abnormality detection output at the time of occurring any abnormality; in which operation of the mentioned load relay is preferably controlled conforming to a diagnostic result of the operation of the mentioned second integrated circuit element carried out by the mentioned first mutual diagnostic means, a diagnostic result of the operation of the mentioned first integrated circuit element carried out by the mentioned second mutual diagnostic means, and the output of the mentioned abnormality detection means.

As a result of the mentioned first feature, in the on-vehicle engine control apparatus of the invention, one single microprocessor can integrally control the first control output and the second control output closely related to the engine speed control. This facilitates transmitting and receiving mutually related control signals thereby response and performance in control being improved.

Furthermore, the load relay is operated on the basis of a diagnostic result of the first mutual diagnostic means and the second mutual diagnostic means cooperating each other in detecting an abnormality and an abnormality detection output of the abnormality detection means that monitors an abnormality in the operation of the sensor system, the control system, and the actuator system related to the throttle valve control. Consequently, safety performance is improved and one single CPU can carry out integrally the engine drive control and the throttle control.

As a second feature, in the foregoing on-vehicle engine control apparatus of the invention, a first group of on-off input sensors of high-speed and high frequency operation necessary for engine drive control and a first group of analog input sensors and a second group of analog input sensors in association with an engine operation state is connected to the mentioned first integrated circuit element; a second group of on-off input sensors of low-speed and low frequency operation necessary for the engine drive control is connected to the mentioned second integrated circuit element; and on-off signals from the mentioned second group of on-off input sensors are inputted to the mentioned microprocessor of the mentioned first integrated circuit element via the mentioned serial interfaces.

As a result of the mentioned second feature, in the foregoing on-vehicle engine control apparatus of the invention, it is possible to transmit and receive a large number of input signals between the first integrated circuit element and the second integrated circuit element via the serial interfaces. Input terminals of the first integrated circuit element including the microprocessor are considerably reduced. Consequently it is possible that the first integrated circuit element is composed of an integrated circuit of small chip and, furthermore, it is possible to add a logic circuit and the like for improving the performance and responsiveness of the microprocessor.

As a third feature, in the foregoing on-vehicle engine control apparatus of the invention, the mentioned first group of analog input sensors includes a first accelerator position sensor for detecting a degree of working the accelerator pedal and a first throttle position sensor for detecting a throttle valve opening; sensor outputs from the mentioned first group of analog input sensors are inputted to the mentioned microprocessor of the mentioned first integrated circuit element via a first A/D converter; the mentioned second group of analog input sensors includes a second accelerator position sensor for detecting a degree of working the accelerator pedal and a second throttle position sensor for detecting a throttle valve opening; and sensor outputs from the mentioned second group of analog input sensors are inputted to the mentioned microprocessor of the mentioned first integrated circuit element via a second A/D converter.

As a result of the mentioned third feature, in the foregoing on-vehicle engine control apparatus of the invention, both analog sensors for throttle control and the A/D converters are constituted into a dual system. The sensor outputs can be processed in the first integrated circuit element including the microprocessor. Consequently, any abnormality in the analog input system is easily judged and safety is improved.

As a fourth feature, in the foregoing on-vehicle engine control apparatus of the invention, the mentioned microprocessor of the mentioned first integrated circuit element generates a third control output acting as an auxiliary drive output of low-speed and low-frequency operation to peripheral auxiliary machinery such as a transmission solenoid valve, an air conditioner driving electromagnetic clutch, on the basis of on-off signals from the mentioned first group of on-off input sensors, sensor outputs from the mentioned first group of analog input sensors, sensor outputs from the mentioned second group of analog input sensors, and on-off signals from the mentioned second group of on-off input sensors transmitted from the mentioned second integrated circuit element via the mentioned serial interfaces, and the generated mentioned third control output is outputted from the mentioned second integrated circuit element via the mentioned serial interfaces.

As a result of the mentioned fourth feature, in the foregoing on-vehicle engine control apparatus of the invention, it is possible to transmit and receive a large number of output signals between the first integrated circuit element and the second integrated circuit element via the serial interfaces. Input terminals of the first integrated circuit element including the microprocessor are considerably reduced. Consequently it is possible that the first integrated circuit element is composed of an integrated circuit of small chip and, furthermore, it is possible to add a logic circuit and the like for improving the performance and responsiveness of the microprocessor.

As a fifth feature, in the foregoing on-vehicle engine control apparatus of the invention, the mentioned first mutual diagnostic means carries out check of reply response time to serial communication data transmitted from the mentioned first integrated circuit element to the mentioned second integrated circuit element and sum check of reply data, and the mentioned first mutual diagnostic means further carries out check of period of receiving communication data transmitted regularly from the second integrated circuit element to the mentioned first integrated circuit element.

As a result of the mentioned fifth feature, in the foregoing on-vehicle engine control apparatus of the invention, the load relay is not driven when the communication is abnormal, and the load relay is interrupted without fail in case of any communication abnormality, thereby improving safety.

As a sixth feature, in the foregoing on-vehicle engine control apparatus of the invention, the mentioned second mutual diagnostic means includes: a watchdog timer circuit for generating a restarting reset output to the mentioned microprocessor when the mentioned microprocessor generates watchdog timer clear signals at intervals exceeding a predetermined time between one signal and another; and a communication check circuit for carrying out check of intervals at which serial communication data repeatedly transmitted from the mentioned first integrated circuit element to the mentioned second integrated circuit element are received and sum check of received data.

As a result of the mentioned sixth feature, in the foregoing on-vehicle engine control apparatus of the invention, while the first mutual diagnostic means is dependent on the software, the second mutual diagnostic means is dependent on the hardware and, consequently, safety is improved by supplementing function each other.

As a seventh feature, in the foregoing on-vehicle engine control apparatus of the invention, the mentioned second mutual diagnostic means includes: a circulating data memory for storing circulating data transmitted from the mentioned second integrated circuit element to the mentioned first integrated circuit element; a circulated data memory for receiving and storing circulation-completed data sent back to the mentioned second integrated circuit element after the circulating data stored in the mentioned circulating data memory are transmitted to various memories in the mentioned first integrated circuit element; and a comparison and judgment circuit for judging whether or not contents of the circulating data stored in the mentioned circulating data memory are coincident to contents of the circulation-completed data stored in the mentioned circulation-completed data memory.

As a result of the mentioned seventh feature, in the foregoing on-vehicle engine control apparatus of the invention, the second mutual diagnostic means carries out a self-diagnosis of the control operation of the microprocessor, and it is possible to further improve safety while the second mutual diagnostic means and the first mutual diagnostic means supplementing function each other.

As an eighth feature, in the foregoing on-vehicle engine control apparatus of the invention, the mentioned means for detecting an abnormality includes: a motor disconnection/short-circuit detection circuit for detecting an abnormality in the actuator system by detecting disconnection or short circuit of the mentioned motor and in wiring for feeding electricity to the mentioned motor; first sensor abnormality detection means for detecting an abnormality in the sensor system by detecting a disconnection/short-circuit abnormality and a relative output abnormality in the mentioned pair of accelerator position sensors; second sensor abnormality detection means for detecting an abnormality in the sensor system by detecting a disconnection/short-circuit abnormality and a relative output abnormality in the mentioned pair of throttle position sensors; and loop abnormality detection means for detecting an abnormality in the control system including any abnormality in actuator by comparing outputs of virtual throttle position computing means that operates conforming to operation of the mentioned accelerator position sensors with outputs of the mentioned throttle position sensors.

As a result of the mentioned eighth feature, in the foregoing on-vehicle engine control apparatus of the invention, not only an abnormality in the motor system related to the throttle control and an abnormality in the analog sensors but also an abnormality in the whole of the sensor system, the actuator system, and the control system related to the throttle control are detected, and it is therefore possible to make multiple check thereby improving safety.

As ninth additional feature, in the foregoing on-vehicle engine control apparatus of the invention, the on-vehicle engine control apparatus includes: a power supply detection circuit for detecting whether a power switch to the on-vehicle engine control apparatus is on or off; an abnormality storage element which is set at least by an abnormality detection output of the mentioned second mutual diagnostic means and an abnormality detection output of the mentioned motor disconnection/short-circuit detection circuit and is reset by the mentioned power supply detection circuit; and a gate element which is disposed between a load relay drive output generated by the mentioned second integrated circuit element and the mentioned load relay, and interrupts the mentioned load relay conforming to outputs of the mentioned abnormality storage element, a part of outputs of the mentioned means for detecting an abnormality, and outputs of the mentioned mutual diagnostic means.

As a result of the mentioned ninth feature, in the foregoing on-vehicle engine control apparatus of the invention, when any abnormality in feed circuit of the motor is detected, impatient detection of disconnection or short circuit is stopped until the power supply is turned on again, which prevents giving damage to the drive circuit of the motor.

Further, in case of occurring any abnormality on the first integrated circuit element side including the microprocessor, operation of the load relay is stopped until the power supply is turned on again thereby improving safety.

Furthermore, in a case where the microprocessor falls in a temporary malfunction due to noises or the like, the microprocessor immediately returns to its normal conditions. Thus, it is possible to continue normally operation of the ignition control, the fuel injection control, and so on. The throttle control affecting the safety in driving is once stopped and recovered by turning on the power switch again, thereby preventing any danger, which can be recognized by the driver.

As a tenth feature, an on-vehicle engine control apparatus according to the invention includes: a motor for carrying out an intake throttle valve opening control conforming to an output of one of a pair of accelerator position sensors that detects a degree of working an accelerator pedal and an output of one of a pair of throttle position sensors that detects the mentioned throttle valve opening; a load relay that controls an electric power supply to the mentioned motor; and a default position return mechanism that returns the mentioned throttle valve opening to a limp driving default position when the mentioned load relay interrupts the electric power supply; in which the control apparatus is supplied with a power from an on-vehicle battery via a power supply switch and generates at least a first control output that carries out drive control of the mentioned motor, a second control output that controls a solenoid valve for injecting a fuel to an engine, and a third output that drives the mentioned load relay; the mentioned on-vehicle engine control apparatus further including: minimum threshold value setting means for setting a minimum threshold value that operates when a normal throttle position sensor output is not received and sets a predetermined engine speed slightly higher than an idle engine speed that is a minimum engine speed necessary for maintaining stable rotation of the engine; normal threshold value means for setting a normal threshold value that operates when a normal throttle position sensor output is received and calculates and sets an engine speed which is approximately in inverse proportion to the throttle valve opening detected by the throttle position sensor; and engine speed suppressing means for suppressing an engine speed that operates when the mentioned load relay is interrupted, and suppresses an engine speed by adjusting a fuel supply amount on the basis of the mentioned second control output, in response to a deviation between a predetermined engine speed set by the mentioned minimum threshold value setting means or by the normal threshold value setting means and an actual engine speed.

As a result of the mentioned tenth feature, in the foregoing on-vehicle engine control apparatus of the invention, safety is improved by returning the throttle valve opening to the predetermined position using a fail-safe mechanism independent of electronic control. Even when the throttle valve opening is not returned to the normal position due to any abnormality in the fail-safe mechanism and none of the throttle position sensors are operating normally, it is possible to carry out limp driving at the minimum threshold engine speed.

Further, even when the throttle valve opening is not returned to the normal position due to any abnormality in the fail-safe mechanism, it is possible to carry out limp driving at the normal threshold engine speed as long as the throttle position sensors are effective.

Furthermore, the mentioned normal threshold engine speed makes it possible to obtain an approximately constant engine output torque irrespective of a degree of the throttle valve opening that is stopped due to any abnormality.

As an eleventh feature, in the foregoing on-vehicle engine control apparatus of the invention, the mentioned engine speed suppressing means includes: auxiliary brake operation judgment means for detecting operation of an auxiliary brake acting as auxiliary braking means for keeping a vehicle stationary; throttle position sensor abnormality judgment means for judging that none of the throttle position sensors work normally due to a disconnection/short-circuit abnormality and a relative comparison abnormality of any pair of throttle position sensors disposed in dual system; and engine speed setting means for setting an engine speed by the mentioned minimum threshold value setting means when the mentioned auxiliary brake is applied to stop the vehicle or when there is any abnormality in the throttle position sensor output, and setting an engine speed by the mentioned normal threshold setting value means when the throttle position sensor output is normal and the mentioned auxiliary brake is released.

As a result of the mentioned eleventh feature, in the on-vehicle engine control apparatus of the invention, at the time of limp driving, it is possible to release the auxiliary brake and move the vehicle forward and backward while adjusting a foot brake acting as the main braking means. When actuating the auxiliary brake, the engine speed lowers and the vehicle can be stopped safely. Consequently, it is possible to improve limping gradability by setting a relatively high engine speed with the mentioned normal threshold setting value means.

Furthermore, even when both throttle valve opening and throttle position sensors are abnormal, the engine speed can be limited within a speed limit at which the vehicle can be stopped safely by the minimum threshold engine speed setting means.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. An on-vehicle engine control apparatus including: a motor for carrying out an intake throttle valve opening control conforming to an output of one of a pair of accelerator position sensors that detects a degree of working an accelerator pedal and an output of one of a pair of throttle position sensors that detects said throttle valve opening; and an engine drive that includes at least one fuel injection solenoid valve;

said on-vehicle engine control apparatus comprising:

a load relay that feeds said motor with a power supply and returns said throttle valve opening to a predetermined position by interrupting said power supply;

a first integrated circuit element that includes a microprocessor and generates a first control output for controlling a throttle valve to said motor and a second control output to said engine drive;

a second integrated circuit element that is connected to said first integrated circuit element via a serial interface and generates a driving output to said load relay in cooperation with said microprocessor of said first integrated circuit element;

first mutual diagnostic means that is incorporated in said first integrated circuit element and diagnoses whether or not there is any abnormality in operation of said second integrated circuit element;

second mutual diagnostic means that is incorporated in said second integrated circuit element and diagnoses whether or not there is any abnormality in operation of said first integrated circuit element; and abnormality detection means that monitors operation of a sensor system, a control system, and an actuator system related to said throttle valve control at all times and generates an abnormality detection output at the time of occurring any abnormality;

wherein operation of said load relay is preferably controlled conforming to a diagnostic result of the operation of said second integrated circuit element carried out by said first mutual diagnostic means, a diagnostic result of the operation of said first integrated circuit element carried out by the mentioned second mutual diagnostic means, and the output of the mentioned abnormality detection means.

2. The on-vehicle engine control apparatus according to claim 1, wherein a first group of on-off input sensors of high-speed and high frequency operation necessary for engine drive control and a first group of analog input sensors and a second group of analog input sensors in association with an engine operation state is connected to said first integrated circuit element;

a second group of on-off input sensors of low-speed and low frequency operation necessary for the engine drive control is connected to said second integrated circuit element; and on-off signals from said second group of on-off input sensors are inputted to the mentioned microprocessor of said first integrated circuit element via said serial interfaces.

3. The on-vehicle engine control apparatus according to claim 2, wherein said first group of analog input sensors includes a first accelerator position sensor for detecting a degree of working the accelerator pedal and a first throttle position sensor for detecting a throttle valve opening;

sensor outputs from said first group of analog input sensors are inputted to said microprocessor of said first integrated circuit element via a first A/D converter;

said second group of analog input sensors includes a second accelerator position sensor for detecting a degree of working the accelerator pedal and a second throttle position sensor for detecting a throttle valve opening; and sensor outputs from said second group of analog input sensors are inputted to said microprocessor of said first integrated circuit element via a second A/D converter.

4. The on-vehicle engine control apparatus according to claim 1, wherein said microprocessor of said first integrated circuit element generates a third control output acting as an auxiliary drive output of low-speed and low-frequency operation to peripheral auxiliary machinery, on the basis of on-off signals from said first group of on-off input sensors, sensor outputs from said first group of analog input sensors, sensor outputs from said second group of analog input sensors, and on-off signals from the mentioned second group of on-off input sensors transmitted from the mentioned second integrated circuit element via the mentioned serial interfaces; and said generated third control output is outputted from said second integrated circuit element via said serial interfaces.

5. The on-vehicle engine control apparatus according to claim 4, wherein said peripheral auxiliary machinery is at least one of a transmission solenoid valve and an air conditioner driving electromagnetic clutch.

6. The on-vehicle engine control apparatus according to claim 1, wherein said first mutual diagnostic means carries out check of reply response time to serial communication data transmitted from said first integrated circuit element to said second integrated circuit element and sum check of reply data, and said first mutual diagnostic means further carries out check of period of receiving communication data transmitted regularly from the second integrated circuit element to said first integrated circuit element.

7. The on-vehicle engine control apparatus according to claim 1, wherein said second mutual diagnostic means includes:

a watchdog timer circuit for generating a restarting reset output to said microprocessor when said microprocessor generates watchdog timer clear signals at intervals exceeding a predetermined time between one signal and another; and a communication check circuit for carrying out check of intervals at which serial communication data repeatedly transmitted from said first integrated circuit element to said second integrated circuit element are received and sum check of received data.

8. The on-vehicle engine control apparatus according to claim 1, wherein said second mutual diagnostic means includes:

a circulating data memory for storing circulating data transmitted from said second integrated circuit element to said first integrated circuit element;

a circulated data memory for receiving and storing circulation-completed data sent back to said second integrated circuit element after the circulating data stored in said circulating data memory are transmitted to various memories in said first integrated circuit element; and a comparison and judgment circuit for judging whether or not contents of the circulating data stored in said circulating data memory are coincident to contents of the circulation-completed data stored in said circulation-completed data memory.

9. The on-vehicle engine control apparatus according to claim 1, wherein said abnormality detecting means includes:

a motor disconnection/short-circuit detection circuit for detecting an abnormality in the actuator system by detecting disconnection or short circuit of said motor and in wiring for feeding electricity to said motor;

first sensor abnormality detection means for detecting an abnormality in the sensor system by detecting a disconnection/short-circuit abnormality and a relative output abnormality in said pair of accelerator position sensors;

second sensor abnormality detection means for detecting an abnormality in the sensor system by detecting a disconnection/short-circuit abnormality and a relative output abnormality in said pair of throttle position sensors; and loop abnormality detection means for detecting an abnormality in the control system including any abnormality in actuator by comparing outputs of virtual throttle position computing means that operates conforming to operation of the mentioned accelerator position sensors with outputs of said throttle position sensors.

10. The on-vehicle engine control apparatus according to claim 1, wherein the on-vehicle engine control apparatus includes:

a power supply detection circuit for detecting whether a power switch to the on-vehicle engine control apparatus is on or off;

an abnormality storage element which is set at least by an abnormality detection output of said second mutual diagnostic means and an abnormality detection output of said motor disconnection/short-circuit detection circuit and is reset by said power supply detection circuit; and a gate element which is disposed between a load relay drive output generated by said second integrated circuit element and the mentioned load relay, and interrupts said load relay conforming to outputs of said abnormality storage element, a part of outputs of said means for detecting an abnormality, and outputs of said mutual diagnostic means.

11. An on-vehicle engine control apparatus including: a motor for carrying out an intake throttle valve opening control conforming to an output of one of a pair of accelerator position sensors that detects a degree of working an accelerator pedal and an output of one of a pair of throttle position sensors that detects said throttle valve opening; a load relay that controls an electric power supply to said motor; and a default position return mechanism that returns said throttle valve opening to a limp driving default position when said load relay interrupts the electric power supply; in which said control apparatus is supplied with a power from an on-vehicle battery via a power supply switch and generates at least a first control output that carries out drive control of said motor, a second control output that controls a solenoid valve for injecting a fuel to an engine, and a third output that drives said load relay;

said on-vehicle engine control apparatus comprising:

minimum threshold value setting means for setting a minimum threshold value that operates when a normal throttle position sensor output is not received and sets a predetermined engine speed slightly higher than an idle engine speed that is a minimum engine speed necessary for maintaining stable rotation of the engine;

normal threshold value means for setting a normal threshold value that operates when a normal throttle position sensor output is received and calculates and sets an engine speed which is approximately in inverse proportion to the throttle valve opening detected by the throttle position sensor; and engine speed suppressing means for suppressing an engine speed that operates when said load relay is interrupted, and suppresses an engine speed by adjusting a fuel supply amount on the basis of said second control output, in response to a deviation between a predetermined engine speed set by said minimum threshold value setting means or by the normal threshold value setting means and an actual engine speed.

12. The on-vehicle engine control apparatus according to claim 11, wherein said engine speed suppressing means includes:

auxiliary brake operation judgment means for detecting operation of an auxiliary brake acting as auxiliary braking means for keeping a vehicle stationary;

throttle position sensor abnormality judgment means for judging that none of the throttle position sensors work normally due to a disconnection/short-circuit abnormality and a relative comparison abnormality of any pair of throttle position sensors disposed in dual system; and engine speed setting means for setting an engine speed by said minimum threshold value setting means when said auxiliary brake is applied to stop the vehicle or when there is any abnormality in the throttle position sensor output, and setting an engine speed by said normal threshold value setting means when the throttle position sensor output is normal and said auxiliary brake is released.

* * * * *